US006279289B1

(12) United States Patent
Soder et al.

(10) Patent No.: US 6,279,289 B1
(45) Date of Patent: Aug. 28, 2001

(54) METAL FRAMING SYSTEM

(76) Inventors: James T. Soder, 1994 Gallina Cir.; Bruce K. Ostrander, 220 Revell Pointe North, both of Collierville, TN (US) 38017

( * ) Notice: Subject to any disclaimer, the term of this patent is extended or adjusted under 35 U.S.C. 154(b) by 0 days.

(21) Appl. No.: 09/381,216

(22) PCT Filed: Mar. 19, 1998

(86) PCT No.: PCT/US98/05433

§ 371 Date: Sep. 16, 1999

§ 102(e) Date: Sep. 16, 1999

(87) PCT Pub. No.: WO98/41706

PCT Pub. Date: Sep. 24, 1998

Related U.S. Application Data

(60) Provisional application No. 60/040,835, filed on Mar. 19, 1997.

(51) Int. Cl.[7] ..... E06B 9/00

(52) U.S. Cl. ..... 52/656.9; 52/479; 52/481.1; 52/653.1; 52/726.1

(58) Field of Search ..... 52/653.1, 645, 52/479, 481.1, 656.9, 726.1, 726.2, 726.3, 656.2, 656.1; 248/165, 168

(56) References Cited

U.S. PATENT DOCUMENTS

| | | | | |
|---|---|---|---|---|
| 628,643 | | 7/1899 | Abrahams . | |
| 1,581,487 | | 1/1926 | Kohler . | |
| 2,888,689 | * | 6/1959 | Mourot | 5/201 |
| 3,204,382 | | 9/1965 | McGurn . | |
| 3,304,108 | | 2/1967 | Hamilton et al. . | |
| 3,362,736 | | 1/1968 | Halle . | |
| 3,642,310 | | 2/1972 | Hudson . | |
| 3,726,551 | | 4/1973 | Levenberg . | |
| 4,024,691 | | 5/1977 | Hansen et al. . | |
| 4,514,950 | | 5/1985 | Goodson, Jr. . | |
| 4,723,388 | * | 2/1988 | Zieg | 52/665 |
| 5,076,520 | * | 12/1991 | Bro | 5/508 |
| 5,104,074 | * | 4/1992 | Malloy | 52/156 |
| 5,241,717 | * | 9/1993 | Ward | 5/201 |
| 5,419,089 | | 5/1995 | Hill . | |
| 5,485,705 | * | 1/1996 | Guillemet | 52/656.9 |

(List continued on next page.)

OTHER PUBLICATIONS

Instruction sheet entitled "Model No. TSQ Hammock Stand Assembly Instructions," one page.
Instruction sheet entitled "Hammock Chair Stand, Instructions For Assembly," one page.

*Primary Examiner*—Beth A. Stephan
(74) *Attorney, Agent, or Firm*—Butler, Snow, O'Mara, Stevens & Cannada, PLLC

(57) ABSTRACT

A system and method are provided for framing at least a portion of a wide variety of structures. In each embodiment, the framing system includes a base, which may be attached to a foundation of the structure by conventional means, which preferably comprises at least one rectangular or square metal tube. Alternatively, the base may be made of other metal structures. The framing system further includes a plurality of lower connecting members attached to and extending upwardly from the base and a plurality of upwardly extending support members which are interconnected to the lower connecting members. The framing system may further include an upper member and a plurality of upper connecting members attached to and extending downwardly from the upper member. Each of the support members is also interconnected to one of the upper connecting members, which is aligned with one of the lower connecting members. The interconnections between the support members and the corresponding lower and upper connecting members may be achieved by various alternative configurations, but in each case one member has a reduced end portion which is inserted into a non-reduced end portion of the adjacent member. The reduced end portion is preferably achieved by a roll reduction process.

74 Claims, 15 Drawing Sheets

U.S. PATENT DOCUMENTS 5,553,337 * 9/1996 Lin ..... 5/93.2
5,566,523 * 10/1996 Ozanne ..... 52/655.1
5,655,344 8/1997 Moen et al. .
5,729,845 * 3/1998 Hsu ..... 52/120
5,735,100 4/1998 Campbell .
5,803,653 9/1998 Zuffetti .
6,079,181 * 6/2000 Ruff ..... 52/656.2
6,085,481 * 7/2000 Lee ..... 52/656.8

* cited by examiner

METAL FRAMING SYSTEM

CROSS REFERENCES

The subject Application claims the priority benefits of U.S. Provisional Patent Application having Ser. No. 60/040,835 filed on Mar. 19, 1997, entitled "Tool for Swaging Metal Tubing, and Integral Tubular Framing System Incorporating Swaged Metal Tubing."

BACKGROUND

1. Field of the Invention

The present invention relates generally to framing systems used in the construction of buildings, and more particularly to a metal framing system which incorporates hollow metal tubing.

2. Related Art

Known framing systems used in the construction industry are typically made of either wood or metal, with wood framing systems being the most common. As is well known, wood framing systems have enjoyed widespread use, for instance in the construction of residential homes. Wood frames are typically constructed by connecting pieces of wood, such as 2×4's or 2×6's, with nails in a form that creates either the interior or exterior outline of a structure, or both. In known wood framing systems, all major components are typically made of wood, including components which may be referred to in the art as the bottom plate, studs, top plate and roof trusses. With the exception of roof trusses, which utilize miter cuts on the ends of adjacent pieces of wood to accomplish the desired angular relationship between adjacent members, most wood framing systems consist primarily of straight 2×4's nailed together to define the outside and inside areas of the structure and to provide the load bearing support.

Although wood framing systems have enjoyed widespread use, they are subject to several disadvantages. For instance, the process of constructing a wood framing system is relatively slow since all joints within the system are typically connected with several nails. For example, even if the included roof trusses are pre-assembled, it typically takes a framing crew of four people between five and seven working days to frame a 1,500 square foot house.

Furthermore, the quality of the workmanship associated with the construction of wood framing is often poor, especially in conjunction with low and moderate priced housing where builder's profit margins are relatively low and building costs are suppressed as much as possible. The primary result of this poor workmanship is typically the lack of squareness in the structure frame which adversely affects the installation of other components in the structure.

Other disadvantages associated with wood framing is the flammability of wood, and the potential for deterioration due to exposure to weather or insects such as termites or carpenter ants. Another disadvantage is that the system strength may be reduced at angled connections which require a miter cut and attachment with either nails or screws. Yet another disadvantage associated with use of wood framing systems is the depletion of wood as a natural resource.

Although metal framing systems may represent an improvement relative to wood framing systems with regard to improved strength and reduced deterioration, known metal framing systems are also typically subject to one or more disadvantages. For instance, like a wood framing system, the assembly of a metal framing system may be very time consuming since the metal framing system may require nearly as many metal screws as the nails used in a comparable wood framing system to connect adjacent metal components. Moreover, the screws are generally not as quickly inserted as nails, and therefore the metal framed structure may actually require more time to assemble than a comparable wood framed structure. These and other disadvantages associated with metal framing systems may be further illustrated by the following discussion of known metal framing systems.

Metal framing systems have been used for some time in commercial construction and have recently become more popular in residential construction. Known metal framing systems used in these applications commonly include metal components which are formed as three-sided channels, such as U-channels. For instance, these systems may include vertically extending metal channels, which are inserted into the open side of horizontally extending metal channels used for the bottom and top members of the metal framing system. The joints between the vertically and horizontally extending members are typically secured with numerous fasteners such as screws. Additionally, metal straps are often utilized to secure the vertically extending channel members to one another. Accordingly, the assembly of a metal framing system of this type may be very time consuming due to the requirement to secure the numerous fasteners and metal straps.

Another known metal framing system, which is used to frame a carport, utilizes round hollow tubing with one end of each of the round tubing members being inserted into the hollow end of an adjacent round tubing member. The joint between the two round tubing members may then be stabilized with conventional fasteners. The male portion of each joint may be accomplished by a swaging process to reduce an end portion of the corresponding round tubing member. Although the foregoing carport framing system has been advantageously utilized, use of round metal tubing makes it difficult to insert fasteners into the tubing joints which complicates the assembly of the framing system. Furthermore, in some applications, such as when the carport is placed adjacent to a residential structure, the carport frame may not be viewed as aesthetically appealing.

It is often more advantageous to use either square or rectangular metal tubing in certain applications. However, the connection of adjacent components of square or rectangular metal tubing has been subject to the following problems. Known methods of reducing square and rectangular metal tubing include those which utilize one or more dies. With this form of reduction, one end of the square or rectangular tube is crushed by the force created by various configurations of press equipment, with the size of the reduction being determined by the die design. This method of end reduction of square and rectangular metal tubing is subject to the following disadvantages. In the first instance, the end reduction of the tubing may require several "hits" or applications of the press equipment to achieve the desired reduction, with each application adding to the manufacturing cost. Furthermore, the crushing force of the press equipment may cause excessive and/or non-uniform deformation of the tube end. More specifically, one or more sides of the tubing may become concave, thereby reducing the overall strength of the tube and detracting from the smoothness of the transition between the original shape and the reduced end. In certain instances, the excessive and/or non-uniform deformation may be so severe that the reduced end of the tube is not capable of insertion into a tube of the same size prior to reduction, as intended.

Due to the foregoing problems associated with the use of dies to end reduce square and rectangular tubing, connections of adjacent lengths of like-sized square and rectangular metal tubing has generally been accomplished by inserting a smaller tube, of the same shape, inside two adjacent like-sized pieces of rectangular or square metal tubing, and then securing the joint by fastening each section of the outer tubes to the inner tube. Framing systems of this type have been used to frame carports. The inner tube, as well as the required fasteners, add to the cost of this method of joining adjacent sections of square or rectangular metal tubing. Another disadvantage associated with this type of metal framing system is that the strength of the included joints may be be limited to the strength of the required fasteners at each joint.

In view of the foregoing disadvantages associated with known wood and metal framing systems, there is a continuing need for improved framing systems for use in the construction of a wide variety of buildings including residential and commercial structures.

SUMMARY

In view of the foregoing needs, the present invention is directed to a simple, cost effective and efficient system and method for framing at least a portion of a wide variety of structures including, but not limited to the following structures: residential homes; carports; commercial buildings such as office, retail, mini-storage and industrial buildings; apartment and condominium buildings; office build-out and commercial buildings; utility buildings; and modular/kiosk structures. The framing system and method of the present invention utilizes either rectangular or square metal tubing, or a combination thereof, and therefore has several advantages over existing wood framing systems or metal framing systems utilizing components other than rectangular or square metal tubing. For instance, due to the use of rectangular or square metal tubing, systems embodying the principles of the present invention exhibit improved mechanical strength relative to similar wood framing systems or various metal framing systems such as those which utilize open channel members.

The ease of assembling various components of the framing system of the present invention allows a significant reduction in time, and therefore of cost, in framing various structures relative to prior wood or metal framing systems. For instance, the speed of assembly and therefore the reduction in cost associated with the apparatus and method of the present invention is accomplished by interconnecting various components of the framing system by inserting a reduced end portion of one member or component into an adjacent component which is constructed of a like-sized and similarly shaped metal tube, i.e., either rectangular or square, which has not been end reduced. As an example of the time and cost reductions which may be realized using a framing system embodying the principles of the present invention, a 1,500 square foot house may be framed in less than one day using a crew of four people whereas it typically takes a similar sized crew between five and seven working days to frame a similar structure using wood.

The various components of the framing system of the present invention may be manufactured in a plant setting where relatively stringent quality control measures may be applied, resulting in improved workmanship relative to a comparable wood framed structure. More particularly, the squareness of the frame may be significantly improved relative to the squareness of a comparable wood framed structure, which is often less than desirable, especially in low and moderate priced housing where builder's margins are relatively low and costs are typically suppressed as much as possible.

The rectangular and square metal tubes incorporated in the framing systems of the present invention have four sides and a welded seam. Assuming similar size and wall thickness, these metal tubes are significantly stronger than the three-sided metal channels used in many known metal framing systems. Also, as compared to a wood stud, similar sized metal tubing is significantly stronger. Additionally, the four sides of the rectangular and square metal tubes provide flat surfaces which facilitate the attachment of other structures to the framing system.

Another advantage of the framing system of the present invention, at least with respect to prior wood framing systems, is that the metal framing system of the present invention is not subject to deterioration from insects, rotting or warping. Furthermore, the metal framing system of the present invention is not flammable.

According to a first aspect of the present invention, a system is provided for framing at least a portion of a structure which may include a foundation. According to a preferred embodiment, the system includes a base which may be attached to the foundation of the structure, and a plurality of lower connecting members attached to the base and extending upwardly therefrom. Each of the lower connecting members comprises a metal tube selected from the group consisting of rectangular metal tubes and square metal tubes. The system further includes a plurality of upwardly extending support members which also comprise a metal tube selected from the group consisting of rectangular metal tubes and square metal tubes. A plurality of lower joints interconnect the support members and lower connecting members with each of the lower joints interconnecting one of the support members and one of the lower connecting members. The support members have a cross-sectional shape which is substantially the same as the cross-sectional shape of the interconnected one of the lower connecting members. For instance, if the lower connecting member comprises a rectangular metal tube, then the corresponding, interconnected one of the support members also comprises a rectangular metal tube. For each of the lower joints, either the support member or the lower connecting member has a reduced end portion which is inserted into the other of the support member and interconnected one of the lower connecting members.

In one embodiment the reduced end portion, which corresponds to the male portion of the lower joint, comprises the lower end portion of the corresponding support member which is inserted into the interconnected one of the lower connecting members. This may apply to at least a portion of the lower joints. In another embodiment, the reduced end portion comprises an upper portion of the corresponding lower connecting member which is inserted into the interconnected one of the support members, for each one of at least a portion of the lower joints.

The system may further include an upper member, which may be substantially horizontally extending or may alternatively be sloped relative to horizontal. The upper member preferably comprises either a rectangular metal tube or a square metal tube, with the selection depending upon the cross-sectional shape of the support members included in the framing system. A plurality of upper connecting members are attached to the upper member and extend downwardly therefrom, with each of the upper connecting members comprising a metal tube selected from the group consisting of rectangular metal tubes and square metal tubes.

A plurality of upper joints interconnects the upwardly extending support members and the upper connecting members with each of the upper joints interconnecting one of the support members and one of the upper connecting members. The cross-sectional shape of each of the support members matches the cross-sectional shape of the interconnected one of the upper connecting members. For each of the upper joints, either the support member or the upper connecting member has a reduced end portion which is inserted into the other member. In one embodiment, the reduced end portion of each one of at least a portion of the upper joints comprises the upper end portion of the corresponding one of the support members, with the upper end portion being inserted into the corresponding, interconnected one of the upper connecting members. In another embodiment, the reduced end portion of each one of at least a portion of the upper joints comprises a lower end portion of the corresponding one of the upper connecting members, which is attached to the upper member at an upper end portion thereof, with the lower end portion of the upper connecting member being inserted into the corresponding, interconnected one of the support members.

The reduced end portion of each of the upper and lower joints is preferably formed by a roll reduction process, in which the end of the corresponding rectangular or square metal tube to be reduced is inserted into a tool having a plurality of rollers which are configured and arranged to accomplish the desired end reduction of the tube. This process is disclosed in co-pending U.S. patent application Ser. No. 08/957,354.

According to another embodiment, a system is provided for framing at least a portion of a structure having a foundation, such as a residential home. The system comprises a plurality of exterior wall frames interconnected to one another and extending upwardly from the foundation of the structure. Each of the wall frames includes a base attached to the foundation, a plurality of lower connecting members attached to the base and extending upwardly therefrom, and a plurality of upwardly extending support members, with each being interconnected to one of the lower connecting members by one of a plurality of lower joints. Each of the lower connecting members and each of the support members comprises a rectangular metal tube. For each of the lower joints, either the support member or the lower connecting member has a reduced end portion which is inserted into the other member.

Each of the wall frames further includes an upper member comprising a rectangular metal tube and a plurality of upper connecting members attached to the upper member and extending downwardly therefrom. Each of the upper connecting members also comprises a rectangular metal tube and is aligned with one of the lower connecting members. A plurality of upper joints interconnects the support members and the upper connecting members, with each of the upper joints interconnecting one of the support members and one of the upper connecting members. Each of the support members extends between one of the lower connecting members and the aligned one of the upper connecting members. For each of the upper joints, either the support member or the upper connecting member has a reduced end portion which is inserted into the other member. Similar to the previously discussed embodiment, the reduced end portion of each of the lower and upper joints is preferably formed by a roll reduction process.

At least one of the exterior wall frames may further include a window frame disposed between and interconnected to the base and the upper member. The window frame may be connected to the base via a second plurality of lower connecting members attached to the base and extending upwardly therefrom, a plurality of lower window frame connecting members attached to and extending downwardly from the window frame, and a second plurality of upwardly extending support members. Each one of the support members extends between and is connected to one of the second plurality of lower connecting members and an aligned one of the lower window frame connecting members. The joints between each support member and the corresponding one of the lower window frame connecting members and the second plurality of lower connecting member is preferably configured as described previously, i.e., a reduced end portion of one member is inserted into the corresponding adjacent member. The window frame may be connected to the upper member in a similar fashion.

The system may further include an interior wall frame attached to and extending inwardly from one of the exterior wall fires. The interior wall frame may include a base attached to the foundation of the structure, a plurality of lower connecting members attached to and extending upwardly from the base, an upper member spaced apart from the base and a plurality of upper connecting members attached to and extending downwardly from the upper member. The interior wall frame further includes a plurality of upwardly extending members, with each one extending between and connected to one of the lower connecting members and an aligned one of the upper connecting members.

According to another embodiment, a system is provided for framing a structure which may comprise a carport. The system includes first and second bases which are laterally spaced apart from one another. First and second pluralities of lower connecting members are attached to the first and second bases, respectively, and extend upwardly therefrom. A plurality of first side posts are interconnected to the first plurality of lower connecting members via a first plurality of lower joints and a plurality of second side posts are interconnected to the second plurality of lower connecting members, via a second plurality of lower joints. Each of the lower connecting members and side posts comprises a metal tube selected from the group consisting of rectangular metal tubes and square metal tubes. Each side post and the corresponding one of the lower connecting members is interconnected via the corresponding lower joint, in the fashion discussed with respect to previous embodiments. The system further includes a plurality of bridge members, with each of the bridge members extending between and interconnecting one of the first side posts and one of the second side posts.

According to a second aspect of the present invention, a method of constructing a framing system is provided for use in framing at least a portion of a structure. The method comprises the steps of providing a base made of metal, making each of a plurality of lower connecting members from a four-sided metal tube, and attaching each one of the lower connecting members to the base. The method further includes the steps of making each one of a plurality of support members from a four-sided metal tube and interconnecting each of the support members to one of the lower connecting members so that each of the support members extends upwardly from the interconnected one of the lower connecting members.

The step of interconnecting comprises the steps of forming a reduced end portion on one of the support member and the lower connecting member for each interconnected pair of the support members and the lower connecting members, and inserting the reduced end portion into the other member. The step of forming may comprise the step of roll reducing one end of either the support member or the lower connecting member for each interconnected pair of the support members and the lower connecting members.

The method may further include the steps of providing an upper member comprising at least one four-sided metal tube, making each one of a plurality of upper connecting members from a four-sided metal tube, and attaching each one of the upper connecting members to the upper member. The method may further include the steps of interconnecting each of the support members to one of the upper connecting members. This step of interconnecting may comprise the steps of forming a reduced end portion on one of the support member and the upper connecting member for each interconnected pair of the support members and the lower connecting members, and inserting the reduced end portion into the other member. The step of forming the reduced end portion may comprise the step of roll reducing one end of either the support member or the upper connecting member for each interconnected pair of the support members and the upper connecting members.

BRIEF DESCRIPTION OF THE DRAWINGS

These and other features, aspects and advantages of the present invention will become better understood with regard to the following description, appended claims and accompanying drawings, wherein:

DETAILED DESCRIPTION

Figure 1:
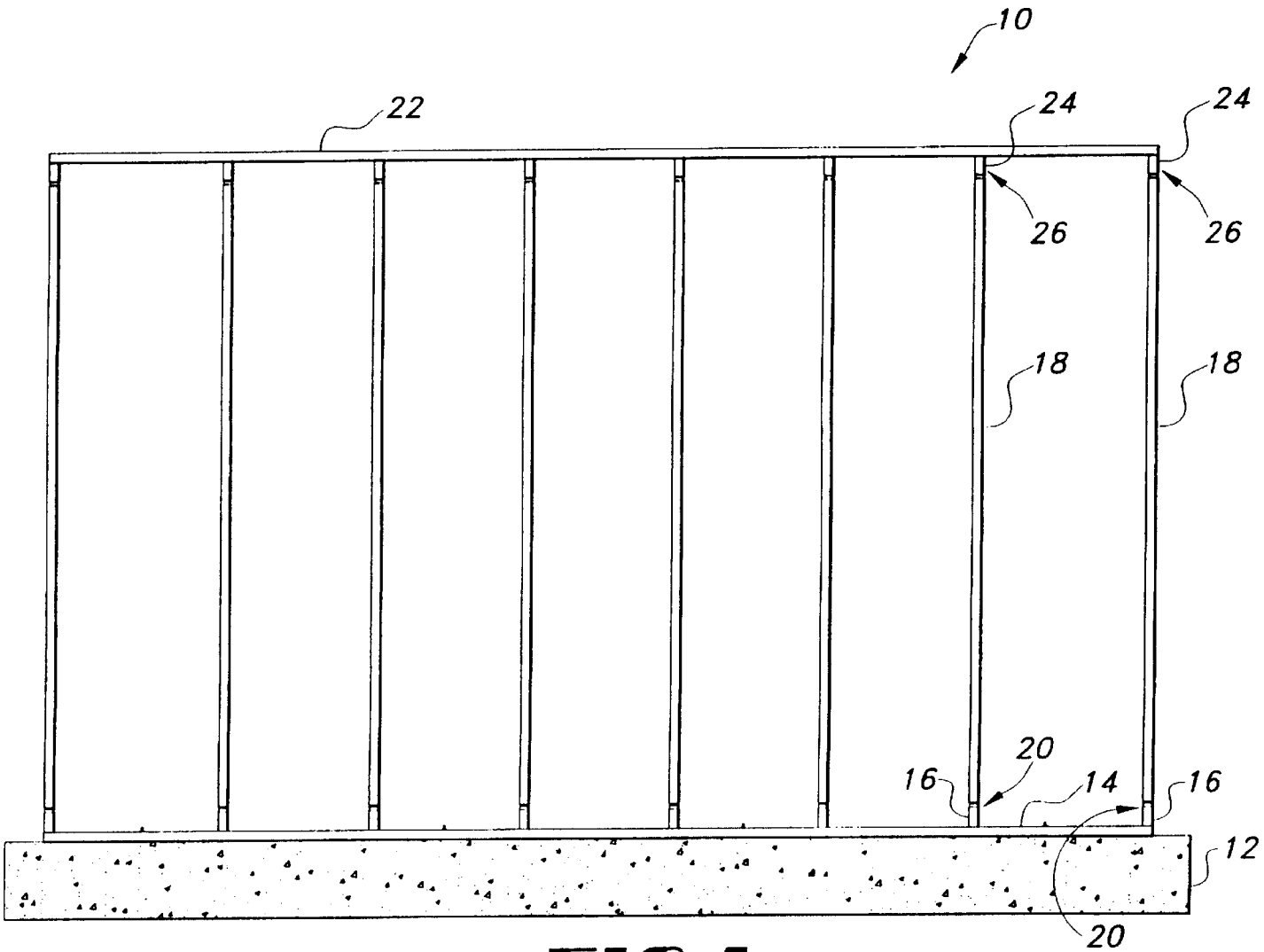
FIG. 1 is an elevation view illustrating a framing system according to a first embodiment of the present invention.

Referring now to the drawings, wherein like reference numerals have been used for similar elements throughout, FIG. 1 is an elevation view illustrating a framing system 10, according to a first embodiment of the present invention. The framing system 10 may be used to frame either an exterior or an interior wall for a wide variety of structures including, but not limited to the following structures: residential homes; carports; commercial buildings such as office, retail, mini-storage and industrial buildings; apartment and condominium buildings; office build-out and commercial buildings; utility buildings; and modular/ kiosk structures. The framing system 10 may be attached to a concrete support structure 12 which may comprise a concrete slab or a portion of a poured concrete foundation. Alternatively, the framing system may be attached to other conventional foundation or support structures. As yet another alternative, in certain applications, the framing system may rest upon a ground surface.

The framing system 10 includes a base 14, which is attached to the concrete support structure 12 by conventional means as subsequently discussed in greater detail. Base 14 is preferably made from either rectangular metal tubing or square metal tubing but may alternatively be made from other metal structures such as metal plates, metal channel sections, and angled metal sections. Additionally, base 14 may be made as either a unitary or one piece construction, or alternatively may be made from a plurality of the foregoing metal components, such as rectangular or square metal tubing, which are attached to one another. In the illustrative embodiments shown in FIGS. 1–8, base 14 is made from a single section of rectangular metal tubing.

As used herein, the term "rectangular metal tubing" refers to hollow metal tubing having a substantially rectangular cross-sectional shape and the term "square metal tubing" refers to hollow metal tubing having a substantially square cross-sectional shape. The rectangular and square metal tubing incorporated in the various embodiments of the framing system of the present invention may be made of steel or aluminum or any other metal or metal alloy which is suitable for use in constructing a system for use in framing a wide variety of structures including, but not limited to those mentioned previously with respect to framing system 10. It is a further requirement with respect to certain components of the various framing systems of the present invention which require an end reduction, that the metal selected to construct the component must be compatible with achieving the end reduction via a roll reduction process as disclosed in co-pending U.S. patent application Ser. No. 08/957,354.

Framing system 10 further includes a plurality of lower connecting members 16 which are preferably made from either rectangular or square metal tubing and are attached to the base 14 by conventional means, such as welding. As shown in FIG. 1, the lower connecting members 16 are spaced apart from one another along base 14, with the particular spacing depending upon the application of system 10. For instance, if the framing system 10 is used to frame the wall of a residential structure, the lower connecting members 16 may be advantageously spaced either 16 or 24 inches from one another due to the common use of this spacing in wood framed residential structures. However, it should be understood that other spacings may be utilized in residential home applications.

The framing system 10 further includes a plurality of upwardly extending support members 18, which may be referred to as studs depending upon the particular application of system 10. Each of the support members 18 is made from either a rectangular metal tube or a square metal tube and is interconnected to one of the lower connecting members 16 via one of a plurality of lower joints 20 as discussed further in conjunction with FIG. 2. The cross-sectional shape of each support member 18 must match the cross-sectional shape of the corresponding or interconnected one of the lower connecting members 16. Accordingly, if a particular lower connecting member 16 is made from a rectangular metal tube, then the interconnected one of the support members 18 must also be made from a rectangular metal tube. Similarly, if a particular lower connecting member 16 is made from a square metal tube, then the interconnected one of the support members 18 must also be made from a square metal tube. The support members 18 extend upwardly from the lower connecting members 16 and, in one preferred embodiment, are substantially vertically extending.

In the illustrative embodiment, the framing system 10 further includes an upper member 22 which is made from at least one rectangular or square metal tube. In the illustrative embodiment, the upper member 22 is made from a single rectangular metal tube, but alternatively may be constructed from a plurality of rectangular metal tubes which may be attached to one another. In other embodiments, when the support members 18 are made from square metal tubes, the upper member 22 may be made from either a single square metal tube or a plurality of square metal tubes. In other embodiments the upper member 22 may be made of other metal components such as metal plates, metal channel sections, and angled metal sections.

Figure 2:
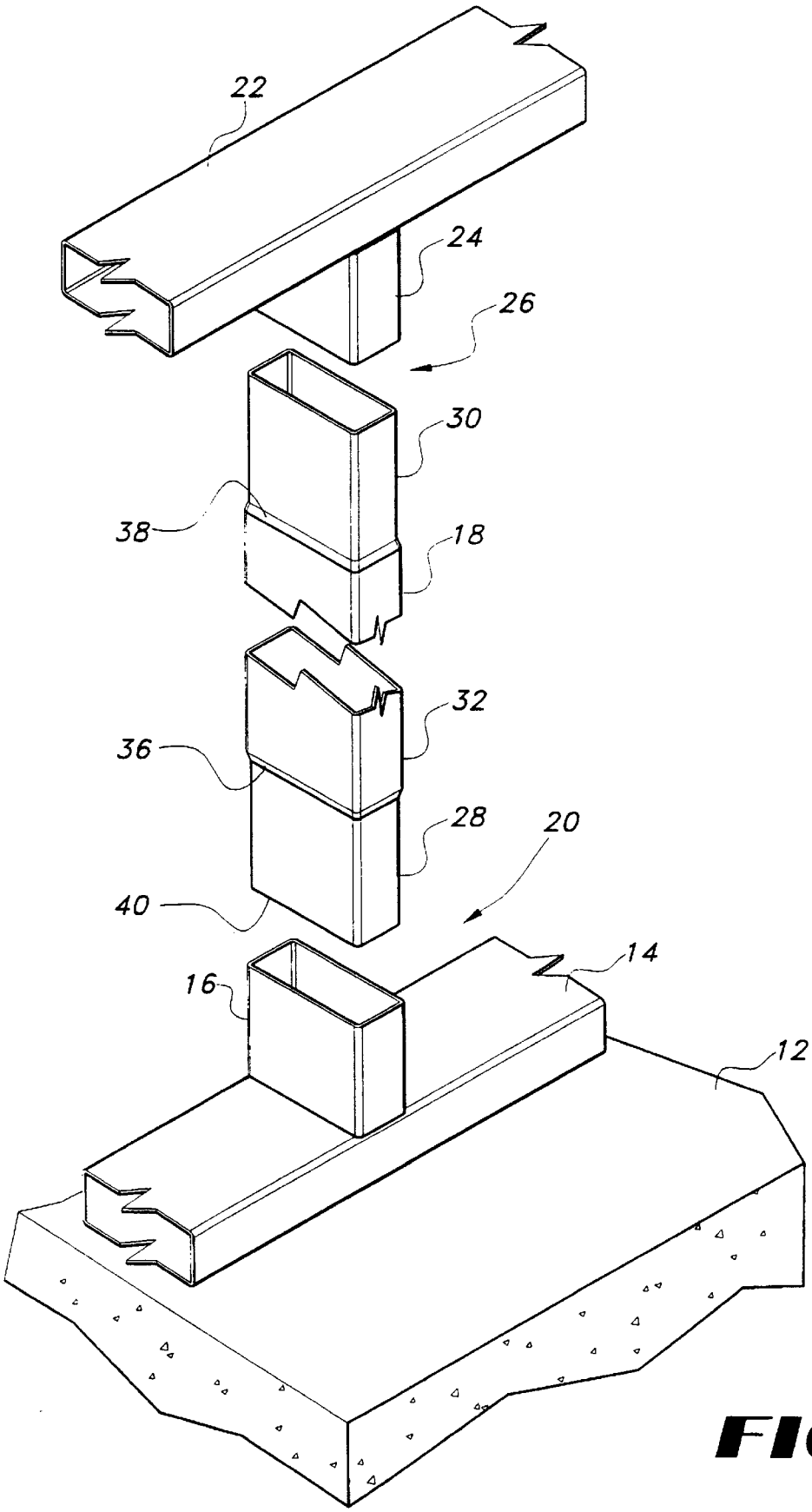
FIG. 2 is a fragmentary, exploded isometric view further illustrating a portion of the framing system shown in FIG. 1.

System 10 further includes a plurality of upper connecting members 24 which are attached to and extend downwardly from the upper member 22. The upper connecting members 24 are made from either rectangular or square metal tubes, with the chosen configuration depending upon the shape of the corresponding support member 18 and lower connecting member 16. For instance, if both the corresponding lower connecting member 16 and support member 18 are made from rectangular metal tubing, then the upper connecting member 24 must also be made from rectangular metal tubing, as shown in FIG. 2. The upper connecting members 24 are attached to the upper member 22 by conventional means, such as welding. Each of the support members 18 is interconnected to one of the upper connecting members 24 via one of a plurality of upper joints 26. Each of the upper connecting members 24 is positioned on the upper member 22 so that it is aligned with one of the lower connecting members 16. Each of the support members or studs 18 extends between one of the lower connecting members 16 and the aligned one of the upper connecting members 24 as shown in FIG. 1.

As shown in FIG. 2, each of the support members 18 includes a lower end portion 28, an upper end portion 30 and an intermediate portion 32 which extends between and is integral with the lower 28 and upper 30 end portions. The lower 28 and upper 30 end portions and intermediate portion 32 are preferably made as a one-piece construction. As shown in FIG. 2, the lower 28 and upper 30 end portions comprise reduced end portions of support member 18 and have a rectangular cross-sectional shape which is reduced in size relative to the rectangular cross-sectional shape of the intermediate portion 32 of the corresponding support member 18.

The reduced, lower end portion 28 of each support member 18 is inserted into the corresponding lower connecting member 16 which has a rectangular cross-sectional shape which may be the same size as that of the intermediate portion 32 of the support member 18. In this instance, the reduced, lower end portion 28 comprises the male portion of the corresponding lower joint 20, while the lower connecting member 16 comprises the female portion of the corresponding lower joint 20. The reduced end portion 28 and lower connecting member 16 are preferably sized so that they engage one another in a snug fit. Similarly, the reduced, upper end portion 30 of each support member 18 is inserted into the corresponding one of the upper connecting members 24. Accordingly, the upper end portion 30 of each support member 18 comprises the male portion of the corresponding upper joint 26, while the interconnected one of the upper connecting members 24 comprises the female portion of the corresponding joint 26.

The reduced end portions 28 and 30 of each support member 18 are preferably formed by a process which may be referred to as a roll reduction process. As used herein, the term "roll reduction process" is intended to refer to reducing an end portion of either a square or rectangular metal tube by inserting the tube into a tool which incorporates a plurality of rollers which are configured and arranged to achieve the desired end reduction in the tube. More specifically, as used herein, the term "roll reduction process" is intended to refer to achieving the desired end reduction in either a square or rectangular metal tube by utilizing a tool such as tool 10 or tool 100 which are disclosed in co-pending U.S. patent application having Ser. No. 08/957,354 entitled "Tool for Working Shaped, Hollow Metal Tubing to Achieve an End Reduction", which is expressly incorporated by reference herein in its entirety. As shown in application Ser. No. 08/957,354 an end reduction of a square metal tube may be achieved by using tool 10, while an end reduction of a rectangular metal tube may be achieved by using tool 100. For further information regarding the structural features of the tools disclosed and the manner in which an end reduction of a square or rectangular metal tube is achieved, the reader is referred to application Ser. No. 08/957,354.

Figure 4:
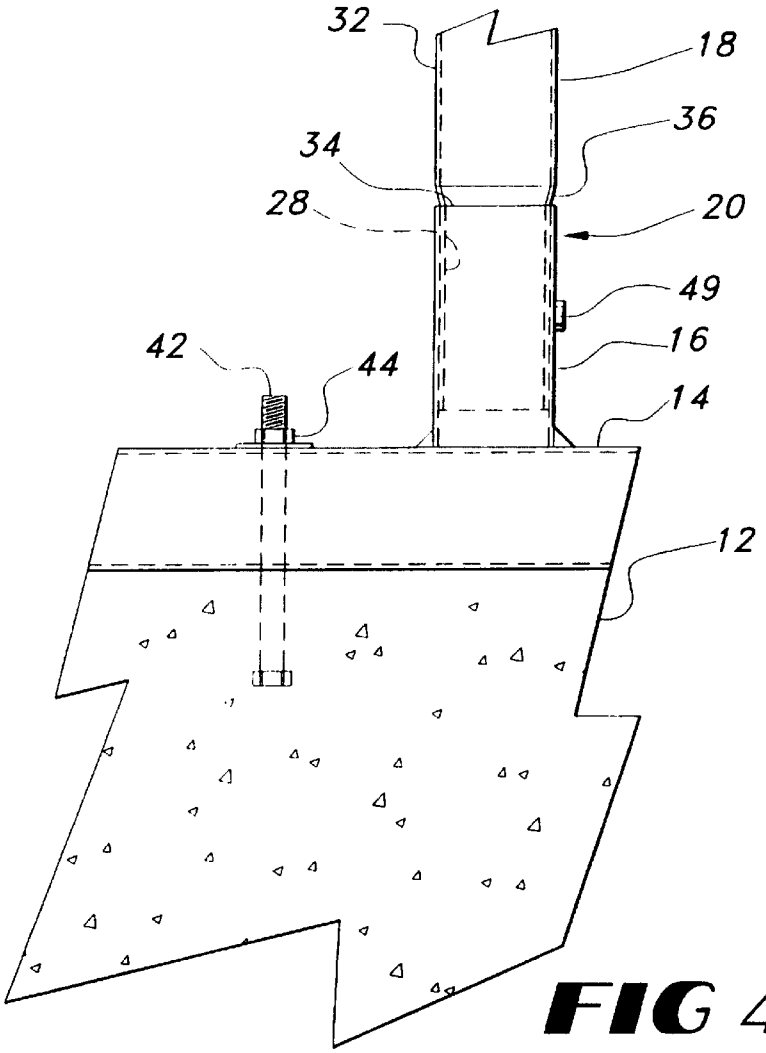
FIG. 4 is an elevation view similar to FIG. 3, illustrating an alternative joint between the two adjacent members shown in FIG. 3.
Figure 3:
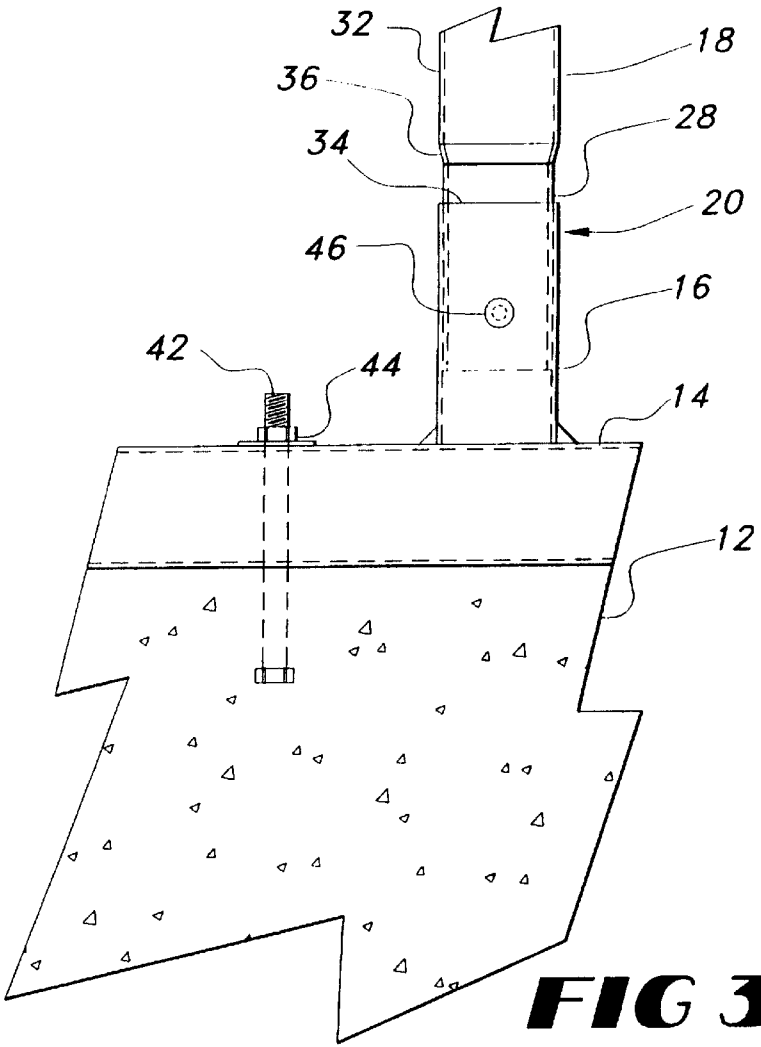
FIG. 3 is a fragmentary elevation view illustrating one means of attaching the framing system shown in FIG. 1 to a concrete slab and illustrating the joint between a pair of adjacent members of the framing system in greater detail.

Referring now to FIGS. 3 and 4 it may be seen that the longitudinal lengths of the lower connecting members 16 and the reduced, lower end portions 28 of the support members 18 may be sized to achieve somewhat different results. For instance, as shown in FIG. 3, the longitudinal length of the lower end portion 28 is greater than that of the corresponding lower connecting member 16 so that the lower end portion 28 extends upwardly above the upper edge 34 of the corresponding lower connecting member 16. As shown in FIGS. 3 and 4, each of the support members 18 may include a lower tapered portion 36, having a relatively small longitudinal length which forms a transition between the intermediate portion 32 and the reduced end portion 28. As shown in FIG. 2, each support member 18 further includes an upper, tapered portion 38, which also has a relatively small longitudinal length, and forms a transition between the intermediate portion 32 and the reduced end portion 30 of member 18.

The relative lengths of the lower connecting member 16 and the reduced end portion 28 shown in FIG. 3 may be desirable in certain applications so that any vertical load existing in the support member 18 is reacted at the interface between a lower edge 40 of support member 18 and base 14. This configuration provides increased surface area to react the load carried by support member 18 as compared to the configuration shown in FIG. 4, for the following reasons. The longitudinal length of the lower connecting member 16 shown in FIG. 4 is substantially the same as the longitudinal length of the reduced end portion 28 of support member 18. Accordingly, a portion of the upper edge 34 of the lower connecting member 16 engages the tapered portion 36 of the support member 18. The entire edge 34 may not contact the tapered portion 36 of member 18 due to the sloped surface of the tapered portion 36. The configuration shown in FIG. 3 may be desirable in instances when the framing system 10 is used to frame a relatively heavily loaded wall, such as that which may be incorporated in a portion of a residential home, for instance. The configuration shown in FIG. 4 may be advantageously utilized when the corresponding support member 18 is subjected to a relatively smaller load.

As shown in FIGS. 3 and 4, the base 14 may be attached to the foundation 12 by a plurality of concrete bolts 42 (one shown in FIGS. 3 and 4), with each bolt 42 being secured by a nut 44. Alternatively, the base 14 may be attached, or secured to the foundation 12 by other conventional means, such as nails, screws, anchor bolts, or equivalent fasteners.

Figure 5:
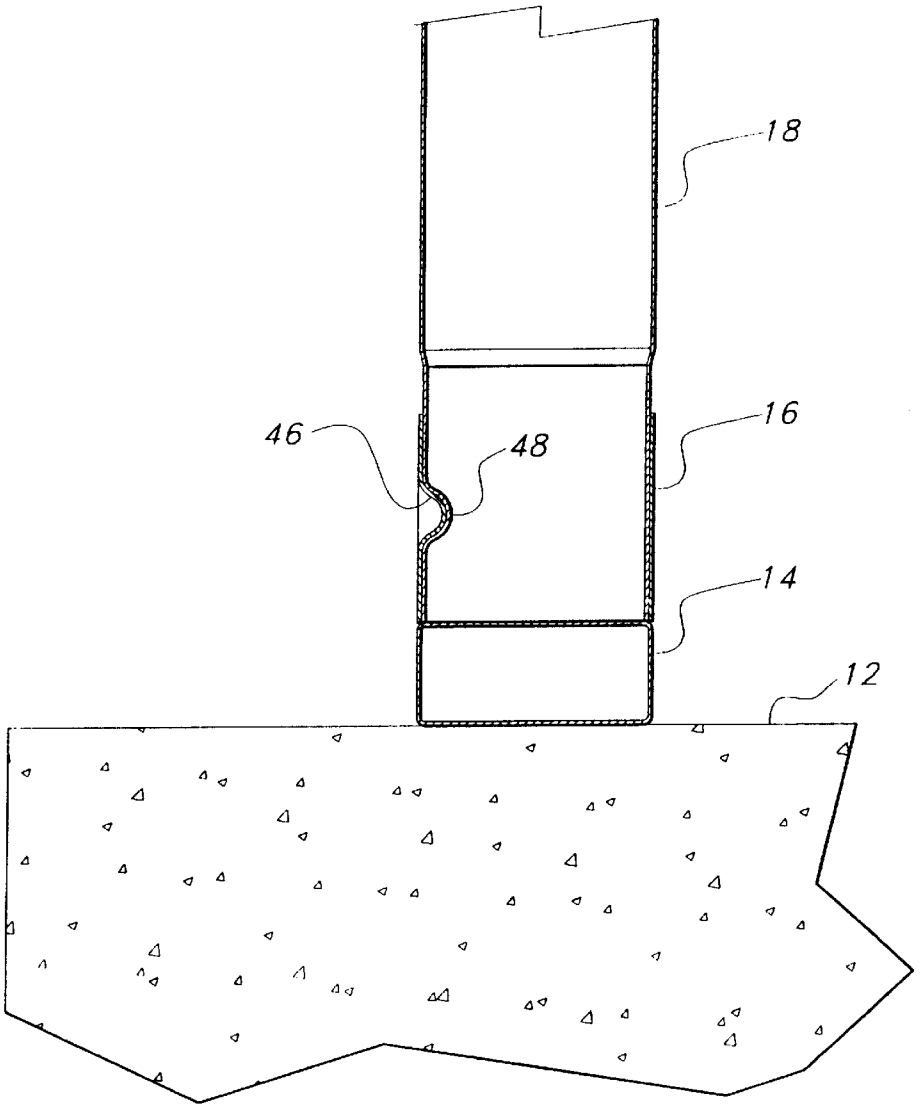
FIG. 5 is a cross-sectional view further illustrating the staked joint shown in FIG. 3.

Each of the lower joints 20 may comprise a staked joint as shown in FIGS. 3 and 5. In this instance, a local indentation 46 is formed in the lower connecting member 16 and a complimentary, local indentation 48 is formed in the lower end portion 28 of the corresponding one of the support members 18 so that the support member 18 and lower connecting member 16 are staked or secured to one another. Alternatively, for one or more of the lower joints 20, the support member 18 and the corresponding lower connecting member 16 may be fastened to one another by conventional fasteners such as bolts or sheet metal screws. As yet another alternative, support members 18 may be secured to the corresponding lower connecting members 16 using nails or pins. Similarly, each of the upper joints may comprise a staked joint, with complimentary local indentations formed in the reduced upper end portion 30 and the corresponding one of the upper connecting members 24. Alternatively, the reduced upper end portion 30 of the support member 18 may be fastened or pinned to the corresponding upper connecting member 24, for one or more of the upper joints 26.

Figure 6:
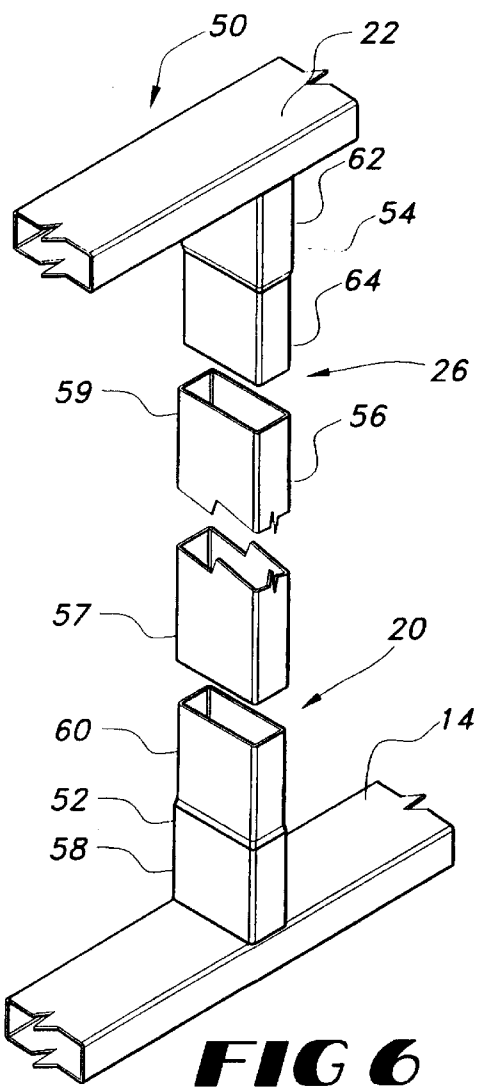
FIG. 6 is a fragmentary, exploded, isometric view illustrating a portion of a framing system according to a second embodiment of the present invention.

FIG. 6 is fragmentary, perspective view illustrating a portion of a framing system 50 according to a second embodiment of the present invention. The framing system 50 is the same as framing system 10 with the following exceptions. Each of the lower connecting members 16 of system 10 is replaced by a lower connecting member 52 which is attached to base 14 by conventional means such as welding and extends upwardly from base 14. Each of the upper connecting members 24 of system 10 is replaced by an upper connecting member 54 which is attached to and extends downwardly from the upper member 22, and each of the support members 18 of system 10 is replaced by an upwardly extending support member 56. Each of the lower 52 and upper 54 connecting members as well as the support members 56 comprises a rectangular metal tube. As shown in FIG. 6, each lower connecting member 52 includes a lower portion 58 which is attached to base 14 and a reduced upper end portion 60 which has a reduced size relative to lower portion 58 which is preferably achieved by the roll reduction process discussed previously. The reduced end portion 60, which comprises the male portion of the corresponding lower joint 20, is inserted into a lower end 57 of the support member 56.

Each of the upper connecting members 54 (one shown) includes an upper portion 62 which is attached to the upper member 22 and a reduced, lower end portion 64 which has a reduced size relative to the upper portion 62. The reduced end portion 64 is preferably formed by the roll reduction process discussed previously. The lower end portion 64 of the upper connecting member 62, which comprises the male portion of the corresponding upper joint 26, is inserted into an upper end 59 of the support member 56.

Figure 7:
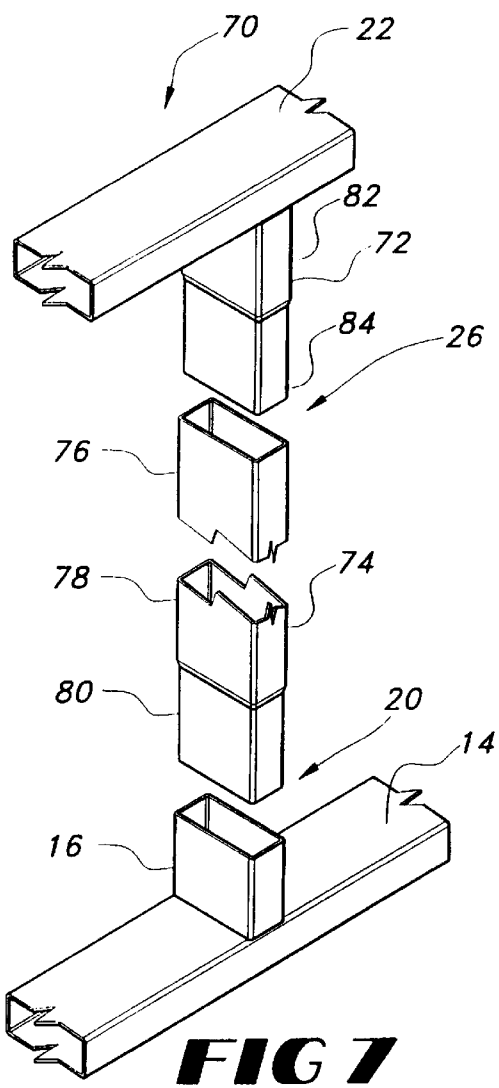
FIG. 7 is a fragmentary, exploded, isometric view illustrating a portion of a framing system according to a third embodiment of the present invention.

FIG. 7 is a fragmentary exploded isometric view illustrating a portion of a framing system 70 according to a third embodiment of the present invention. The framing system 70 is the same as system 50, with the exceptions noted below. Each of the upper connecting members 24 of system 10 is replaced by an upper connecting member 72 which is attached to and extends downwardly from the upper member 22. Each of the support members 18 of system 10 is replaced by a support member 74 which has an upper end portion 76, an intermediate portion 78 and a lower end portion 80. The upper end portion 76 and the intermediate portion 78 are the same size with respect to a rectangular cross-section of each portion. However, the lower end portion 80 has a reduced size relative to portions 76 and 78. The reduced end portion 80 of member 74 comprises a male portion of the corresponding lower joint 20 and is inserted into the corresponding one of the lower connecting members 16.

Each of the upper connecting members 72 includes an upper portion 82 which is attached to the upper member 22 by conventional means such as welding, and a lower end portion 84 which is reduced in size relative to the cross-section of the upper portion 82. The reduced, lower end portion 84 comprises the male portion of the corresponding upper joint 26 and is inserted into the upper end portion 76 of the corresponding support member 74. End portion 80 of member 74 and end portion 84 of member 72 are preferably formed by the roll reduction process discussed previously.

Figure 8:
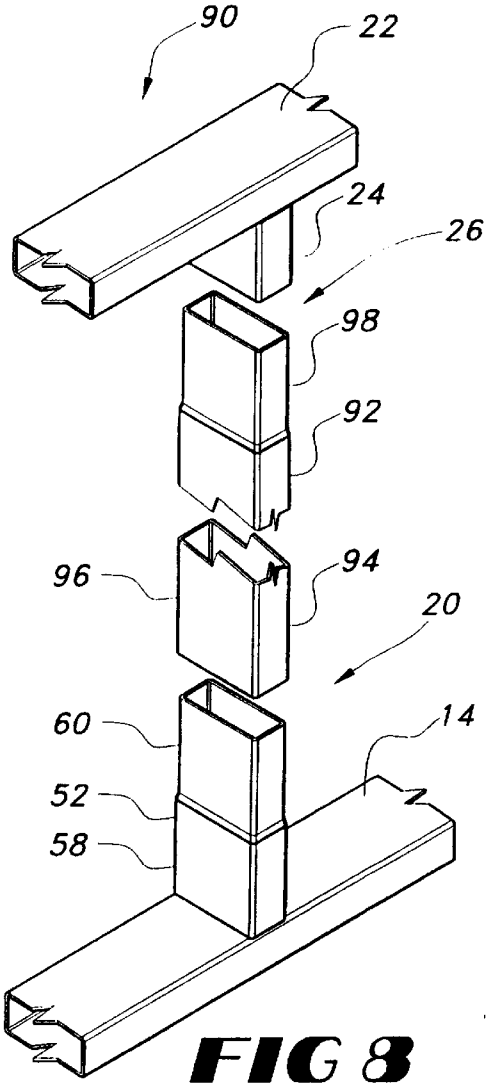
FIG. 8 is a fragmentary, exploded, isometric view illustrating a portion of a framing system according to a fourth embodiment of the present invention.

FIG. 8 is a fragmentary, exploded isometric view illustrating a portion of a framing system 90, according to a fourth embodiment of the present invention. System 90 is the same as system 10, with the following exceptions. Each of the lower connecting members 16 of system 10 is replaced by one of the lower connecting members 52, described previously with respect to system 50, which is attached to the base 14. Additionally, each of the support members 18 of system 10 is replaced by a support member 92 having a lower end portion 94, an intermediate portion 96 having the same cross-sectional size as the lower end portion 94, and an upper end portion 98 which has a reduced cross-sectional size relative to the lower 94 and intermediate portions 96.

The reduced, upper end portion 60 of each of the lower connecting members 52, which comprises a male portion of the corresponding one of the lower joints 20 is inserted into the lower end portion 94 of the corresponding support member 92. End portion 60 is preferably formed by the roll reduction process discussed previously. The reduced, upper end portion 98 of each support member 92 comprises the male portion of the corresponding one of the upper joints 26 and is inserted into the corresponding one of the upper connecting members 24. The upper end portion 98 is also preferably made by the roll reduction process discussed previously.

Figure 9:
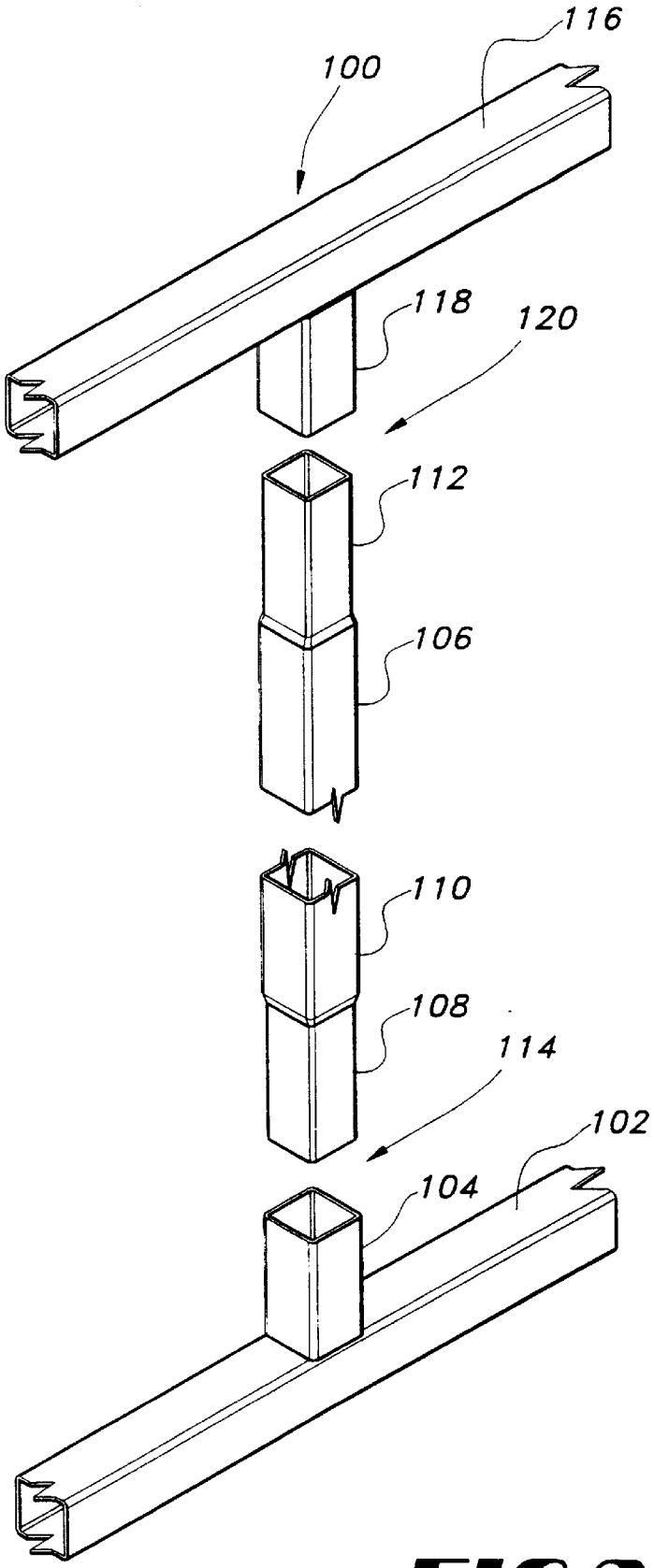
FIG. 9 is a fragmentary, exploded, isometric view illustrating a portion of a framing system according to a fifth embodiment of the present invention.

FIG. 9 is a fragmentary, exploded isometric view illustrating a portion of a framing system 100 according to a fifth embodiment of the present invention. The components of system 100 are the same as the corresponding components of system 10 except that the components of system 100 are made of square metal tubing instead of rectangular metal tubing. System 100 includes a base 102 which, in the illustrative embodiment comprises a square metal tube. Alternatively, the base 102 may be made of other metal structures including metal plates, metal channels and angled metal sections. System 100 further includes a plurality of lower connecting members 104 (one shown) which are attached to base 102 by conventional means such as welding. System 100 further includes a plurality of upwardly extending support members 106 (one shown) which may be substantially vertically extending. Each of the support members 106 includes a lower end portion 108, an intermediate portion 110 and an upper end portion 112. Portions 108, 110 and 112 are preferably made as a one piece construction, with the lower 108 and upper 112 end portions having a reduced cross-sectional size relative to the intermediate portion 110. The reduced end portions 108 and 112 are preferably formed by the roll reduction process discussed previously. Each of the support members 106 is interconnected to one of the lower connecting members 104 via one of a plurality of lower joints 114. The reduced, lower end portion 108 of each of the connecting members 106 comprises a male portion of the corresponding joint 120 and is inserted into the corresponding one of the lower connecting members 104.

System 100 further includes an upper member 116 and a plurality of upper connecting members 118 which are attached to the upper member 116 by conventional means such as welding and extend downwardly therefrom. Each of the support members 106 is interconnected to one of the upper connecting members 118 via one of a plurality of upper joints 120. The reduced, upper end portion 112 of each of the support members 106 comprises a male portion of the corresponding upper joint 120 and is inserted into the corresponding one of the upper connecting members 118. In other embodiments (not shown) of the present invention the lower 104 and upper 118 connecting members and the support members 106 of system 100 may be replaced with similar components made from square metal tubing which are configured as shown in FIG. 6, FIG. 7 or FIG. 8.

Figure 10:
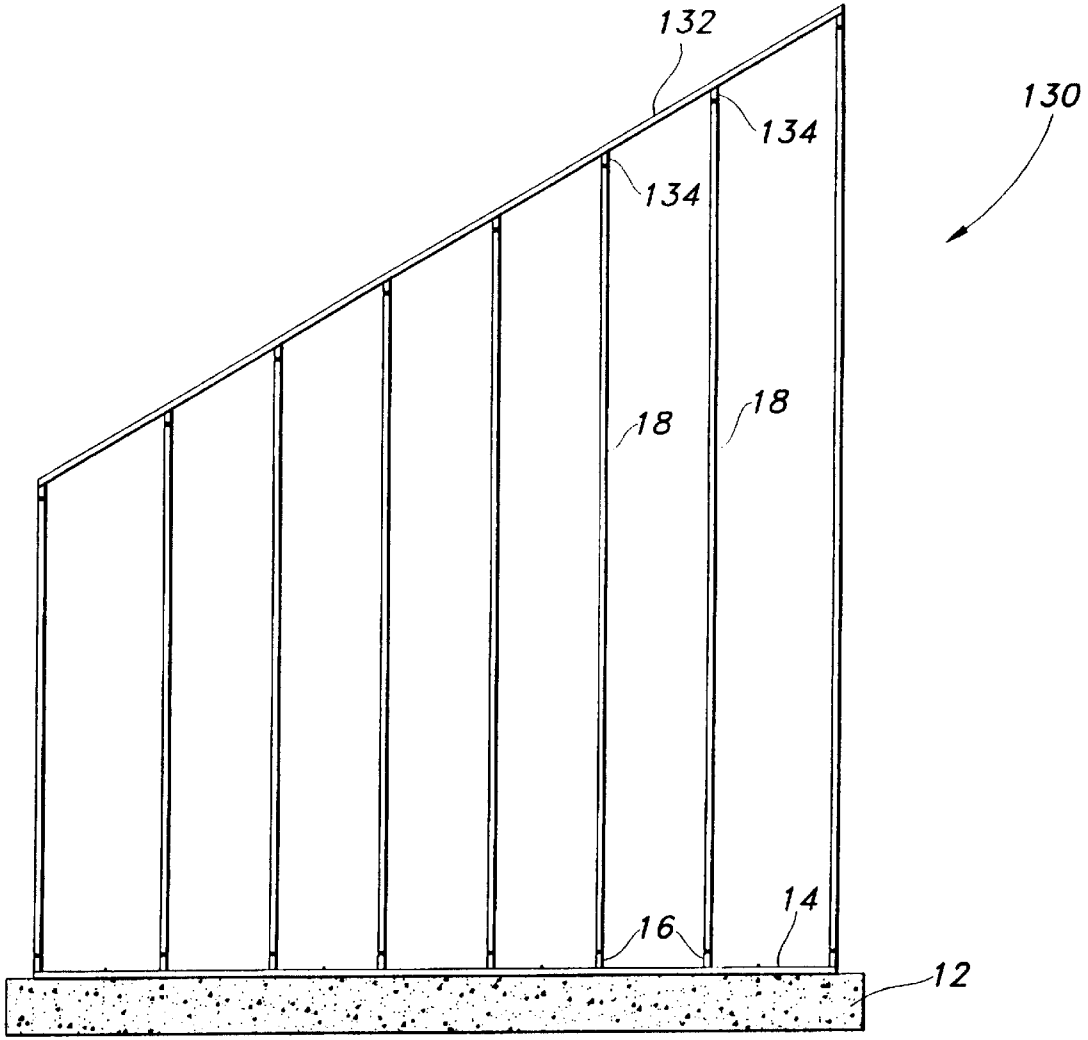
FIG. 10 is an elevation view illustrating a framing system according to a sixth embodiment of the present invention.

FIG. 10 is an elevation view illustrating a framing system 130 according to a sixth embodiment of the present invention. The framing system 130 is the same as framing system 10 with the following exceptions. Framing system 130 includes an upper member 132 which is inclined relative to horizontal, unlike the upper member 22 of framing system 10 which is substantially horizontally extending. Accordingly, the framing system 130 may have particular application for use in framing a structure having a vaulted ceiling. The length of the support members 18 included in system 130 are varied to accommodate the sloped upper member 132. Framing system 130 further includes a plurality of upper connecting members 134, which replace the upper connecting members 24 of system 10. Member 132 and each of the members 134 comprises a rectangular metal tube in the illustrative embodiment. Members 134 are attached to the upper member 132 by conventional means such as welding. The upper edge of each of the upper connecting members 134 is tapered to accommodate the sloped upper member 132. The remaining members of system 130, as well as the manner in which adjacent members are interconnected is the same as system 10. For instance, each of the members 18 of system 130 includes reduced upper and lower end portions (not shown in FIG. 10) which are inserted into the upper 134 and lower 16 connecting members, respectively. The base 14 of system 130 may be attached to the concrete foundation 12 in any of the manners discussed previously with respect to system 10.

In other embodiments (not shown) of the present invention, the upper member 22 of the embodiments illustrated in FIGS. 6–8, or the upper member 116 of the embodiment illustrated in FIG. 9, may be replaced with sloped upper members and the included support members may have varying lengths to accommodate the sloped upper members.

Figure 11:
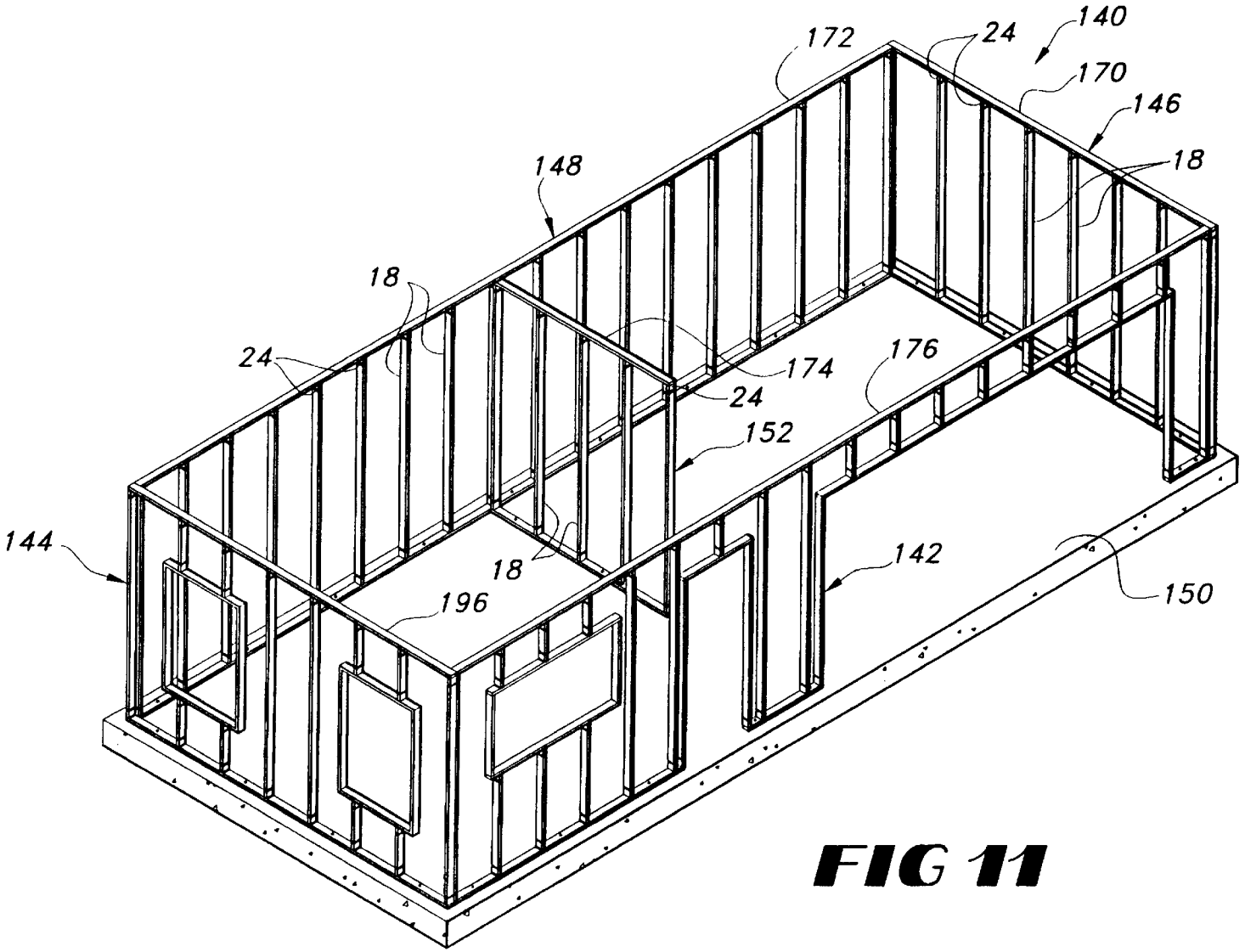
FIG. 11 is an isometric view illustrating a framing system according to a seventh embodiment of the present invention.

FIG. 11 illustrates a framing system 140 according to a seventh embodiment of the present invention which is particularly useful for framing a residential home or a similar, commercial structure. While framing system 140 illustrates the advantageous use of the framing system according to the present invention, with respect to a particular floor plan, it should be understood that the principles of the present invention may be advantageously utilized with an almost unlimited number of floor plans of residential and commercial structures, as well as the other structures mentioned previously. The framing system 140 includes a plurality of exterior wall frames comprising a front wall frame 142 which is shown in further detail in FIG. 12, a first sidewall frame 144 which is shown in further detail in FIG. 13, a second, opposite sidewall frame 146, and a rear wall frame 148. As shown in FIG. 11, the wall frames 142, 144, 146 and 148 are interconnected to one another and extend upwardly from a foundation 150 of the structure. The framing system 140 further includes an interior all frame 152 which is attached to and extends inwardly from the rear wall frame 148.

With the exception of the lengths of the included bases and upper members, and the number of support members, the construction of each of the wall frames 146, 148 and 152 in the illustrative embodiment is the same as the construction of framing system 10 discussed previously. Alternatively, the ends of adjacent components of these wall frames may be as shown previously in FIGS. 6–8. The wall frames 142 and 144 further differ from the framing system 10 due to the incorporation of additional components, comprising one or more window frames or door headers which are included in the wall frames 142 and 144 as subsequently discussed in greater detail.

Figure 14:
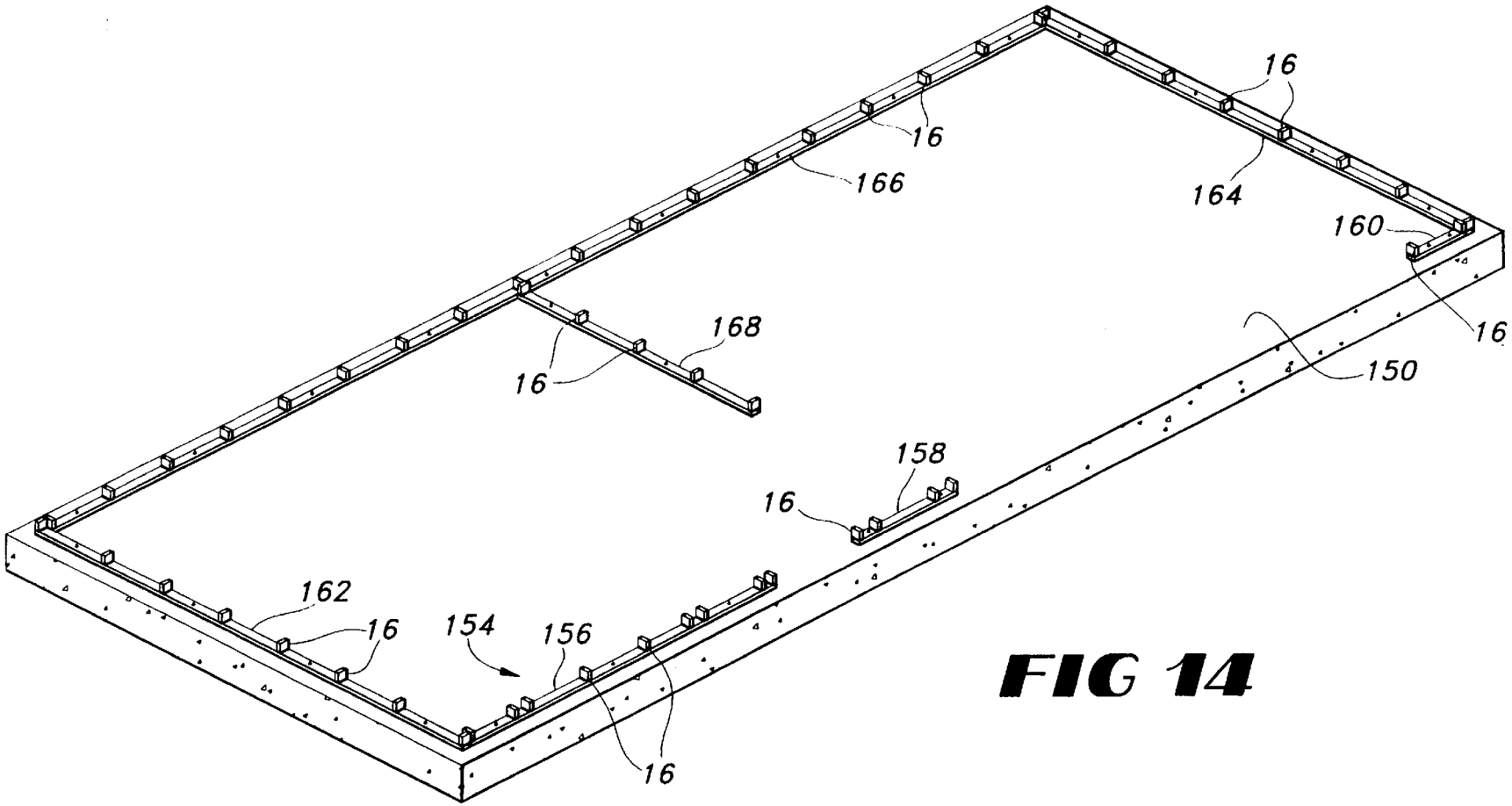
FIG. 14 is an isometric view illustrating a lower portion of the framing system shown in FIGS. 11–13.

Each of the wall frames 142–148 include a base which is attached to the foundation 150 as further shown in FIG. 14. In the illustrative embodiment, the front wall frame 142 includes a base, indicated generally at 154, with base 154 including a first end portion 156, an intermediate portion 158 and a second end portion 160. As shown in FIG. 14, portions 156, 158 and 160 are spaced apart from one another, with each being attached to the foundation 150. The sidewall frames 144 and 146 include bases 162 and 164, respectively, which are attached to the foundation 150. The rear wall frame 148 and interior wall frame 152 include bases 166 and 168 respectively. Each of the bases 154, 162, 164, 166 and 168 comprise one or more rectangular metal tubes in the illustrative embodiment, and may be preferably made of rectangular metal tubing having outside, cross-sectional dimensions of 1½ inches by 3½0 inches. Alternatively, each of the foregoing bases may comprise other metal structures, including metal plates, metal channel sections and angled metal sections. However, all of the remaining components of system 140 are preferably made from rectangular metal tubing, and most preferably are made from 1½ inch by 3½ inch rectangular metal tubing.

In the illustrative embodiment, each of the exterior wall frames 142–148 and the interior wall frame 152 include a plurality of lower connecting members 16 which are attached to the corresponding bases by conventional means such as welding. The wall frame 146 includes an upper member 170, the wall frame 148 includes an upper member 172 and the interior wall frame 152 includes an upper member 174. The wall frames 146, 148 and 152 each further include a plurality of upper connecting members 24, discussed with respect to previous embodiments of the present invention, which are attached to the corresponding one of the upper members 170, 172 and 174 by conventional means such as welding and extend downwardly therefrom. Each of the wall frames 146, 148 and 152 further include a plurality of support members 18 which are constructed as illustrated and discussed previously with respect to FIG. 2, in the illustrative embodiment of framing system 140. Each of the support members 18 of wall frames 146, 148 and 152 extend between and are interconnected to one of the lower connecting members 16 and an aligned one of the upper connecting members 24 in the manner discussed previously with respect to FIG. 2. However, in alternate embodiments, one or more of the support members 18 and the corresponding lower 16 and upper 24 connecting members may be replaced by support members, and lower and upper connecting members which are configured as shown in the framing system embodiments illustrated in FIGS. 6–8. Furthermore, although not presently preferred in residential home applications, square metal tubing may be used to construct at least a portion of the support members and upper and lower connecting members of framing system 140, as illustrated previously with respect to FIG. 9.

Figure 12:
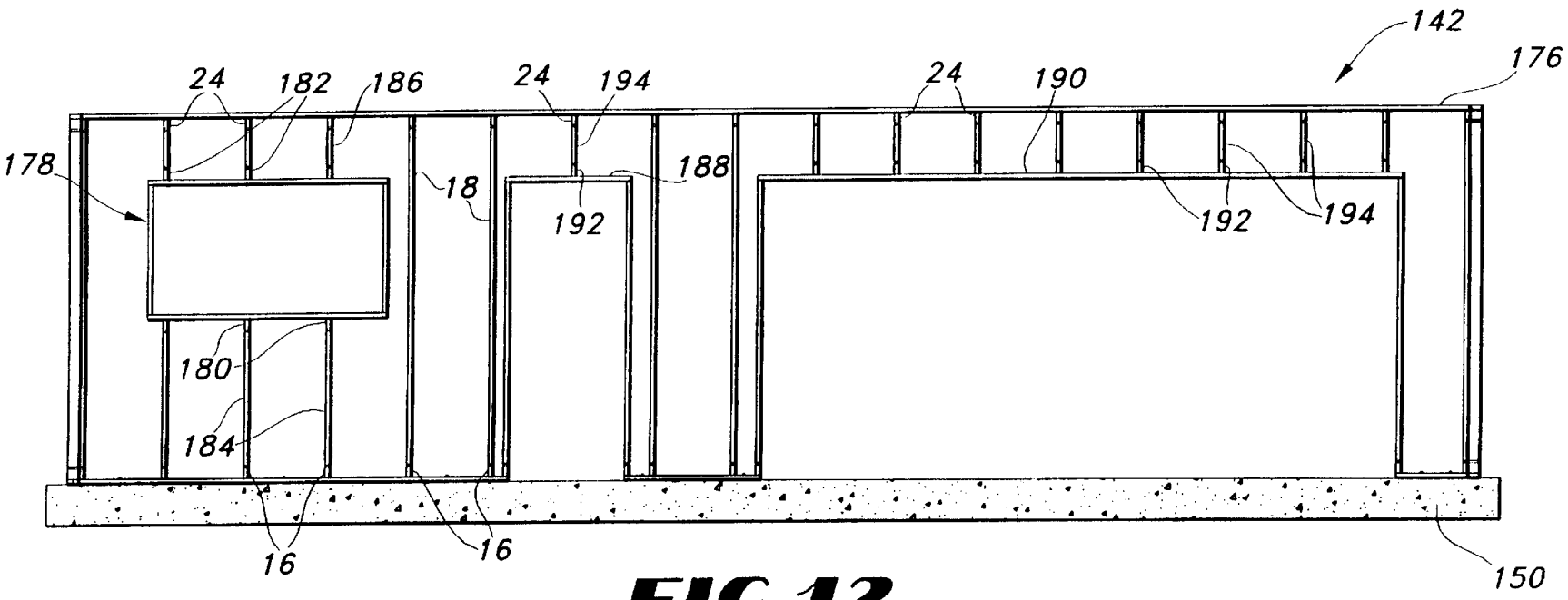
FIG. 12 is a front elevation view further illustrating the framing system shown in FIG. 11.

Referring now to FIG. 12, the front wall frame 142 is illustrated and discussed in further detail. It is noted that for purposes of clarity, the portions of the rear wall frame 148 which would normally be seen by viewing through the front wall frame 142, are not shown in FIG. 12. The front wall frame 142 includes an upper member 176 and a plurality of the upper connecting members 24 which are attached to the upper member 176 by conventional means such as welding and extend downwardly therefrom. As shown in FIG. 12, each one of a portion of the lower connecting members 16 is aligned with one of the upper connecting members 24. The wall frame 142 further includes a plurality of support members 18 which extend between and are interconnected to the lower connecting members 16 and the upper connecting members 24. In the illustrative embodiment, the lower 16 and upper 24 connecting members and support members 18 are configured and are interconnected to one another as illustrated and discussed previously with respect to FIG. 2. Alternatively, these components may be replaced by the lower and upper connecting members and support members shown in any of the embodiments illustrated in FIGS. 6–9, although the configuration shown in FIG. 9 is not presently preferred for use with residential homes.

The wall frame 142 further includes a window frame 178 disposed between and connected to the base 154 and upper member 176 of the wall frame 142. Frame 178 may be made from rectangular metal tubing. Frame 142 further includes a plurality of lower window frame connecting members 180 which are made of rectangular metal tubing and are attached to the window frame 178 by conventional means such as welding and extend downwardly therefrom. Each of the lower window frame connecting members 180 is aligned with one of the lower connecting members 16 attached to base 154. Similarly, the frame 142 further includes a plurality of upper window frame connecting members 182 which are attached to the window frame 178 by conventional means such as welding and extend upwardly therefrom. Each one of the upper window frame connecting members 182 is aligned with one of the upper connecting members 24 attached to the upper member 176. The front wall frame 142 further includes a plurality of support members 184 which interconnect the base 154 and the window frame 178. Each one of the support members 184 extends between and is interconnected to one of the lower connecting members 16 and an aligned one of the lower window frame connecting members 180. Each of the support members 184 may have reduced upper and lower end portions, similar to that shown with respect to support members 18, with the reduced upper and lower end portions being inserted into the lower window frame connecting members 180 and lower connecting members 16, respectively. Alternatively, the lower window frame connecting members 180, lower connecting members 16 and support members 184 may be replaced by similar members which are configured such as those shown in the embodiments illustrated in FIGS. 6–8.

The exterior wall frame 142 further includes a plurality of support members 186 which interconnect the window frame 178 and the upper member 24. Each one of the support members 186 extends between and is interconnected to one of the upper window frame connecting members 182 and the aligned one of the upper connecting members 24. As with the support members 184, the support members 186 may be configured as shown with respect to support members 18, such that an upper end portion (not shown) of each support member 186 is inserted into the corresponding upper connecting member 24, while the reduced lower end portion (not shown) of each one of the support members 186 is inserted into the corresponding one of the upper window frame connecting members 182.

The wall frame 142 further includes a door header 188 and a garage door header 190. Both of the headers 188 and 190 are disposed below and supported by the upper member 176. The headers 188 and 190 may be made from rectangular metal tubing. The wall frame 142 further includes a plurality of header connecting members 192, made of rectangular metal tubing, which are attached to the garage door header 190 by conventional means such as welding and extend upwardly therefrom. At least one of the header connecting members 192 is attached to and extends upwardly from the door header 188. The wall frame 142 further includes a plurality of support members 194, with each one of the support members 194 extending between and being interconnected to one of the header connecting members 192 and an aligned one of the upper connecting members 24, thereby interconnecting the door header 188 and the garage door header 190 with the upper member 176. The support members 194 may be configured with reduced upper and lower end portions as shown with respect to support member 18 and therefore, may be interconnected to the upper connecting members 24 and the header connecting members 192 as shown in FIG. 2 with respect to members 16, 18 and 24. Alternatively, other configurations of rectangular metal tubing, such as the upper and lower connecting members and the support members shown in FIGS. 6–8 may be used to interconnect the door header 188 and garage door header 190 with the upper member 176. However, as stated previously, the use of square metal tubing as shown in FIG. 9 is not presently preferred in residential home applications. This may change in the future due to changes in the construction industry and therefore the use of square metal tubing to construct interconnected components of framing system 140 is considered to be within the scope of the present invention.

Figure 13:
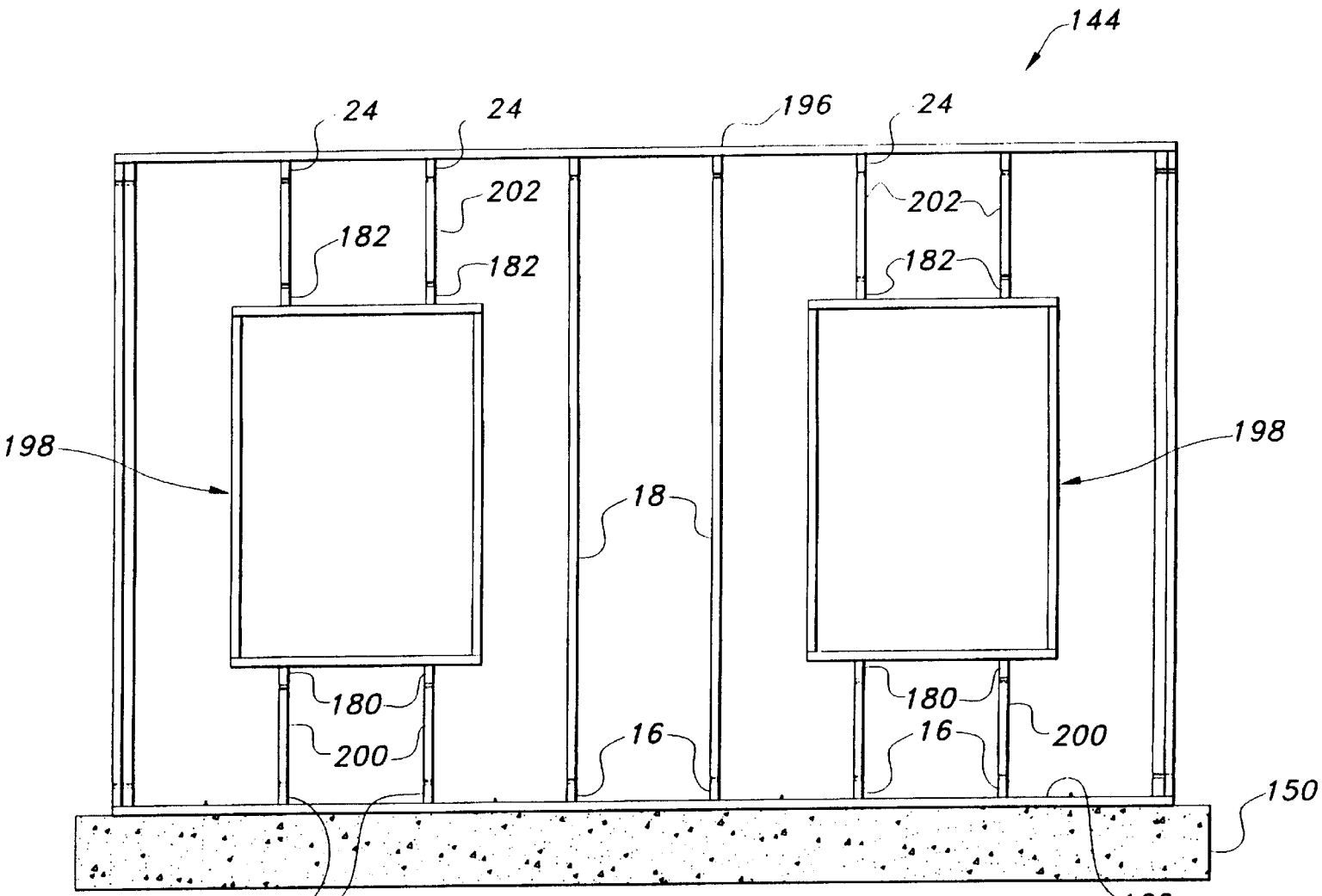
FIG. 13 is a side elevation view further illustrating the framing system shown in FIGS. 11 and 12.

Referring now to FIG. 13, the side wall frame 144 is illustrated and discussed in further detail. The wall frame 144 further includes an upper member 196 and a plurality of the upper connecting members 24 attached to the upper member 196 by conventional means such as welding and extending downwardly therefrom. Frame 144 further includes a plurality of the support members 18, with each one being interconnected to and extending between one of the lower connecting members 16 and an aligned one of the upper connecting members 24. A pair of window frames 198, which may be made from rectangular metal tubing, are disposed between and connected to the base 162 and upper member 196 of wall frame 144. A plurality of the lower window frame connecting members 180 and upper window frame connecting members 182, discussed previously with respect to window frames 178 of wall frame 142, are attached to each one of the window frames 198 of wall frame 144 as shown in FIG. 13. Wall frame 144 further includes a plurality of relatively short support members 200 which interconnect the base 162 and the window frames 198, and a plurality of relatively short support members 202 which interconnect the window frames 198 with the upper member 196. Each of the support members 200 extends between and is interconnected to one of the lower connecting members 16 and an aligned one of the lower window frame connecting members 180. Each of the support members 202 extends between and is interconnected to one of the upper window frame connecting members 182 and an aligned one of the upper connecting members 24. Except for length, members 200 and 202 are the same as members 18.

Figure 15:
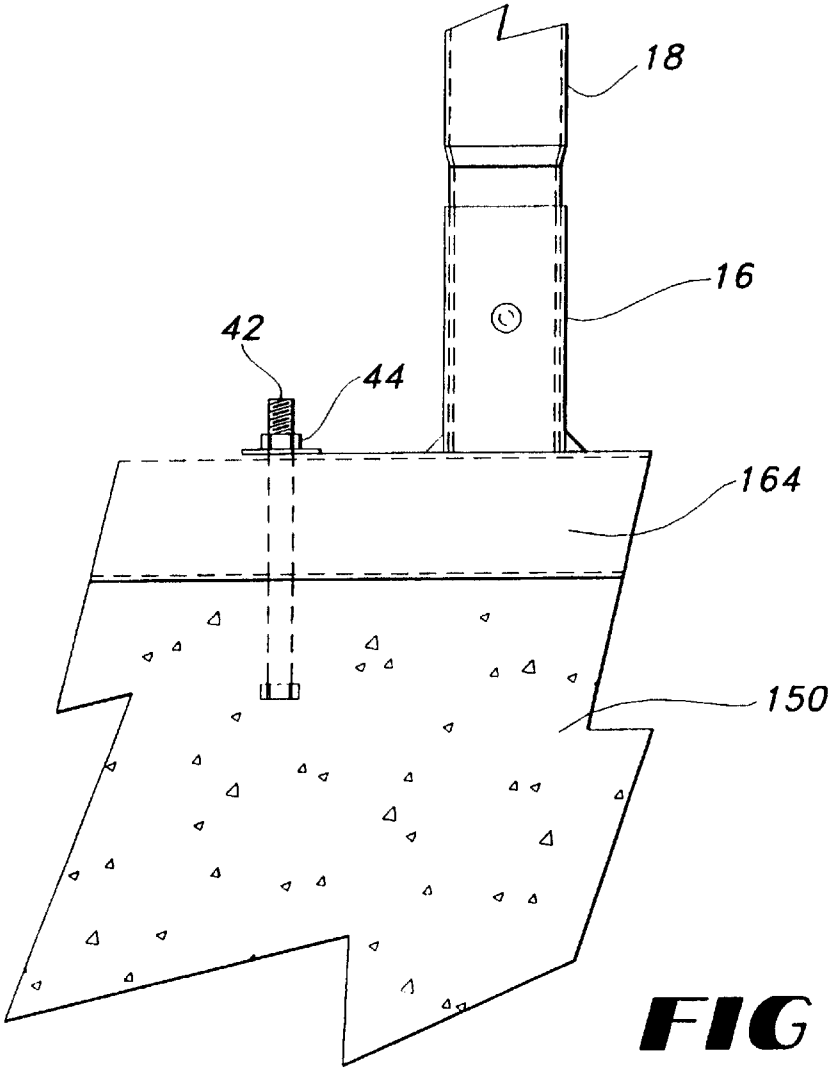
FIG. 15 is a fragmentary elevation view further illustrating one of the staked joints included in the framing system shown in FIGS. 11–14.

The manner in which one of the support members 18 of the side wall frame 146 interfaces with the corresponding lower connecting member 16 is illustrated in FIG. 15 which is similar to FIG. 3 discussed previously with respect to framing system 10. As shown in FIG. 15, the lower, reduced end portion 28 of the member 18 extends above the lower connecting member 16 for purposes of providing increased surface area to react the load carried by support member 18 as discussed previously with respect to framing system 10. The connection shown in FIG. 15 is typical of the manner in which all the support members of framing system 140 are interconnected to the corresponding lower connecting members and to the corresponding upper connecting members.

Figure 16:
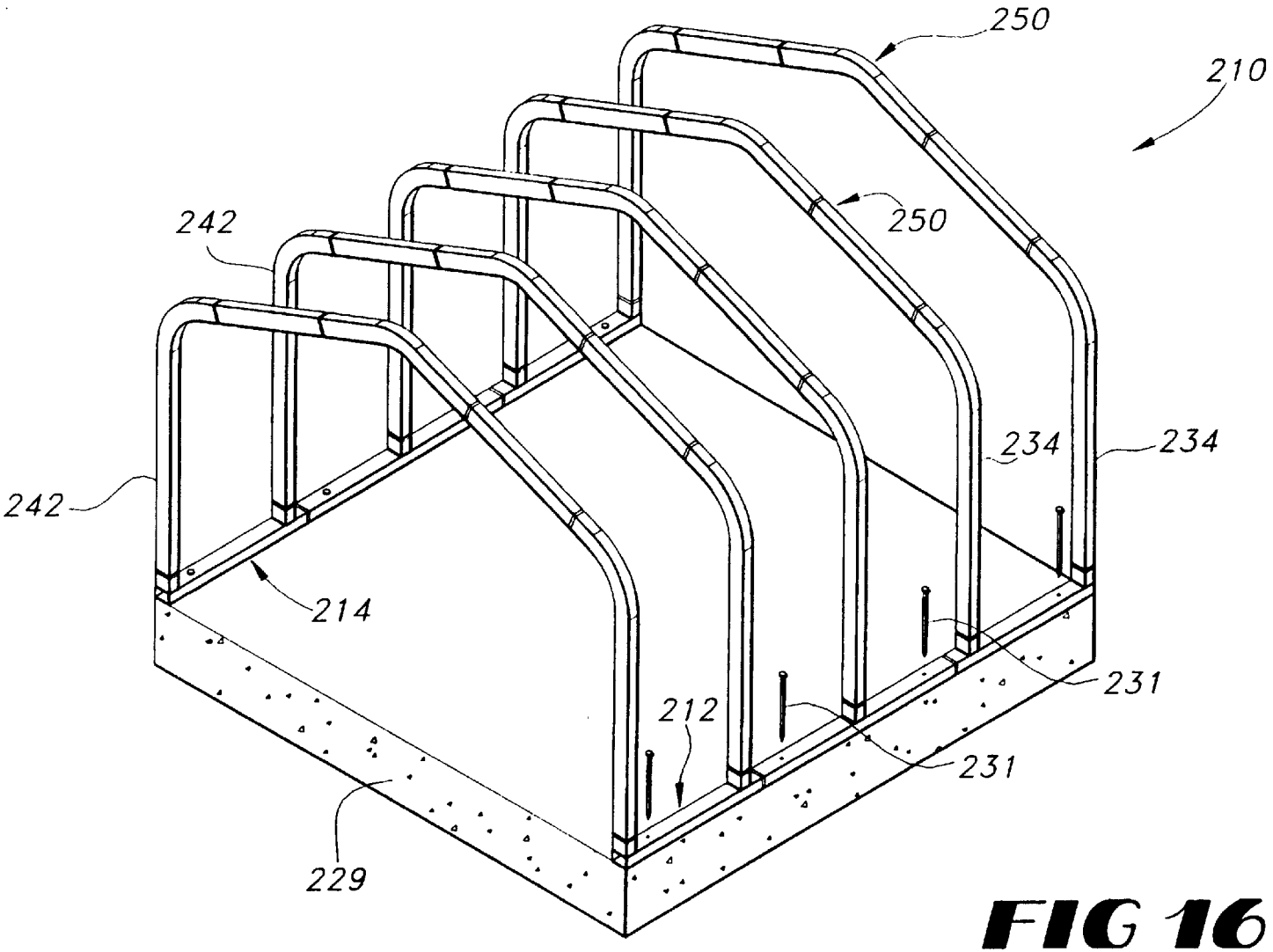
FIG. 16 is an isometric view illustrating a framing system according to an eighth embodiment of the present invention.
Figure 17:
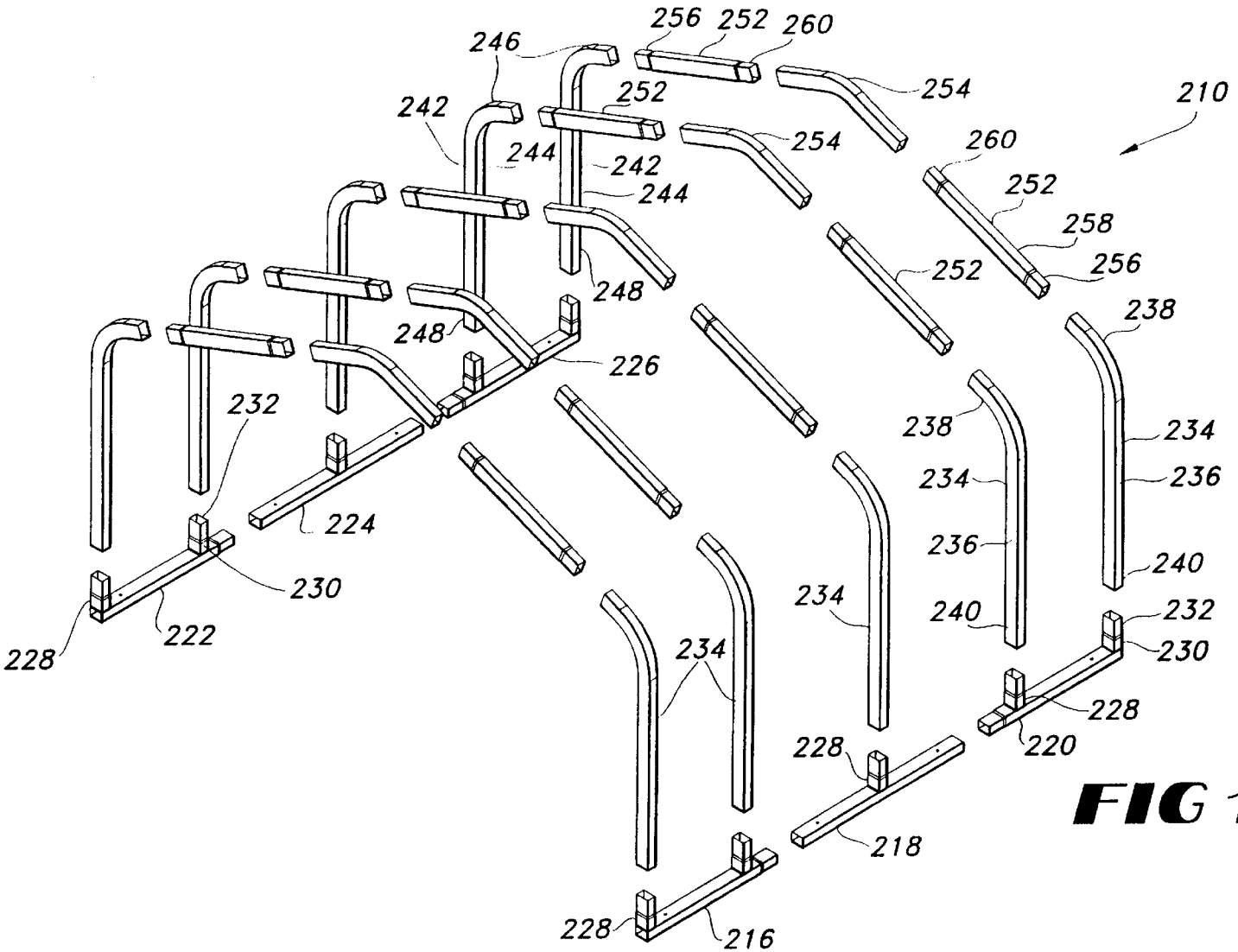
FIG. 17 is an exploded, isometric view of the framing system shown in FIG. 16.
Figure 18:
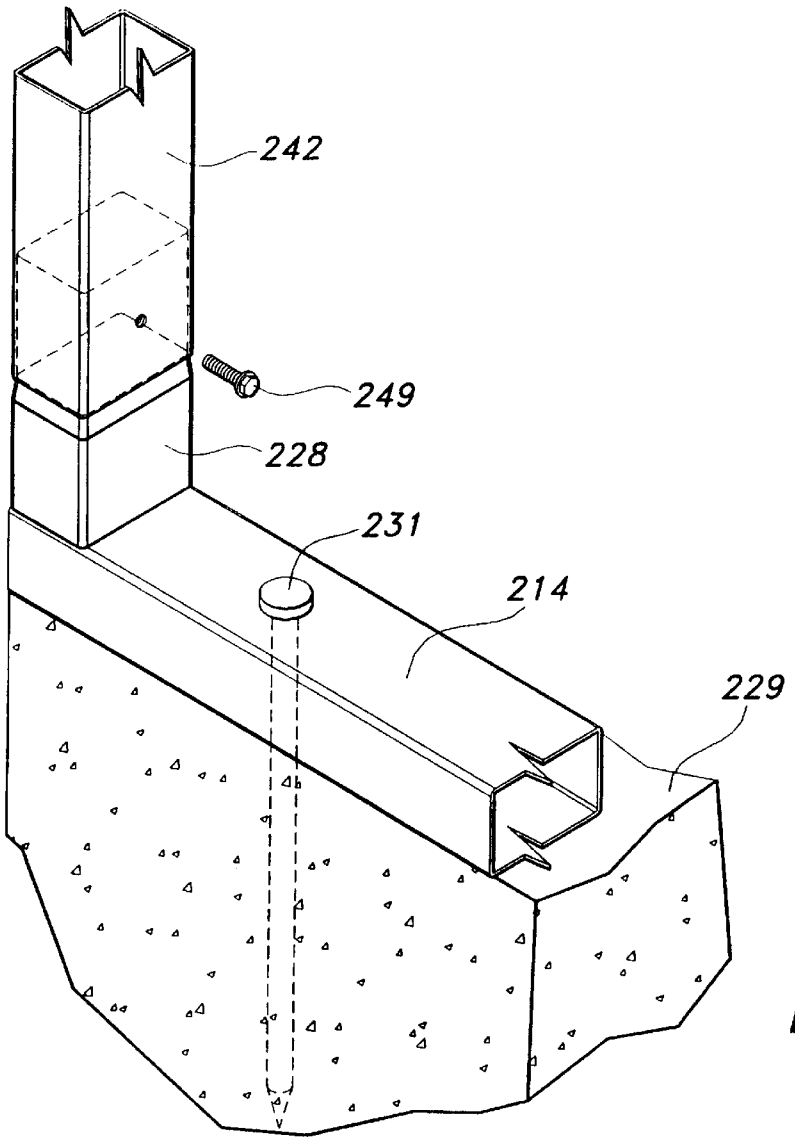
FIG. 18 is a fragmentary, isometric view illustrating a portion of the framing system shown in FIGS. 16 and 17.

FIGS. 16–18 illustrate a framing system 210 according to an eighth embodiment of the present invention. FIG. 16 is an isometric view of the framing system 210 as assembled, while FIG. 17 is an exploded, isometric view showing the various components of the framing system 210 in further detail. The framing system 210 has particular application for use in framing a carport. Framing system 210 includes a first base 212 and a second base 214 which is laterally spaced apart from base 212. As shown in FIG. 17, base 212 includes first 216, second 218 and third 220 portions, and each of the portions 216–220 preferably comprises either a rectangular or square metal tube. Alternatively, portions 216–220 may comprise other metal structures, such as metal plates, channel sections or angled sections. As a further alternative, base 212 may be made as a unitary construction, either out of rectangular or square metal tubing or one of the foregoing alternative metal structures.

Base 214 similarly includes first 222, second 224, and third 226 portions, with each comprising a rectangular metal tube in the illustrative embodiment. However, portions 222, 224 and 226 may alternatively be made of square metal tubing or the alternative metal structures listed previously with respect to base 212. Each of the base portions 216–222 of bases 212 and 214 is attached to a foundation 229 of the carport in the illustrative embodiment by conventional means such as a plurality of nails 231 as further illustrated in FIG. 18. In other embodiments the framing system 210 may rest on a ground surface. The framing system 210 farther includes a first plurality of lower connecting members 228 which are attached to the base 212 by conventional means such as welding, and extend upwardly therefrom. Framing system 210 further includes a second plurality of lower connecting members 228 attached to the base 214 in a similar manner. Each of the lower connecting members 228 includes a lower portion 230 which is attached to the corresponding one of bases 212 and 214, and an upper portion 232 which has a reduced cross-sectional size relative to the lower portion 230. The reduction in size of the upper portion 232 is preferably accomplished by the roll reduction process discussed previously. The framing system 210 further includes a plurality of first side posts 234, with each having a substantially straight portion 236 and an arcuate portion 238 integral with an upper end of the substantially straight portion 236. The reduced end portion 232 of each one of the lower connecting members 228 is inserted into a lower end 240 of the substantially straight portion 236 of one of the first side posts 234.

The framing system 210 further includes a plurality of second side posts 242 which are preferably identical in construction to the side posts 234. Each of the second side posts 242 includes a substantially straight portion 244 and an upper, arcuate portion 246 which is integral with the substantially straight portion 244. The reduced end portion of each one of the second plurality of lower connecting members 228 is inserted into a lower end 248 of the substantially straight portion 244 of one of the second side posts 242. The interconnected members may be further secured by one or more bolts 249 or alternatively the second side posts 242 may be staked to the corresponding lower connecting member 228. The first side posts 234 may be similarly connected to the lower connecting members 228.

As shown in FIGS. 16 and 17, each of the first side posts 234 is aligned with one of the second side posts 242 and is interconnected to the aligned one of the second side posts 242 by a bridge member 250. Each of the bridge members 250 includes a pair of rafters 252 and a peak 254 in the illustrative embodiment. Each of the rafters 252 has a first end portion 256, an intermediate portion 258 and a second end portion 260. The end portions 256 and 260 have a reduced cross-sectional size relative to that of the intermediate portion 258, with the reduced end portions 256 and 258 of rafters 252 preferably being formed by the roll reduction process discussed previously. The end portion 256 of a first one of the rafters 252 of each bridge member 254 is inserted into the arcuate portion 238 of the corresponding one of the first side posts 234. The reduced end portion 256 of the second rafter 252 of each bridge member 250 is inserted into the arcuate portion 246 of the aligned second side post 242. The ends 260 of each of the pair of rafters is then inserted into opposite ends of the corresponding peak 254.

Each of the following components of the framing system 210 preferably comprises a rectangular metal tube and even more preferably comprises a rectangular metal tube having a cross-section which has outside dimensions of 1½ inches× 3½ inches: base portions 216–222; lower connecting members 228; first 234 and second 242 side posts; rafters 252 and peaks 254.

Each bridge member 250 may alternatively comprise a unitary construction or as another alternative, may be constructed of fewer or greater components provided the same overall shape of each bridge member 250 is substantially retained. Furthermore, the configurations of the ends of selected components of the flaming system 210 may be varied to achieve the same results. For instance, each of the lower connecting members 228 may comprise a substantially uniformly shaped rectangular tube, with the lower ends 236 and 248 of the first 234 and second 242 side posts comprising reduced end portions which are inserted into the corresponding lower connecting members 228.

The arcuate portions of the first 234 and second 242 side posts, as well as peaks 254 is achieved by bending the corresponding rectangular metal tubes and provides the advantage of eliminating mitered joints which might otherwise be required.

While the foregoing description has set forth the preferred embodiments of the present invention in particular detail, it must be understood that numerous modifications, substitutions and changes can be undertaken without departing from the true spirit and scope of the present invention as defined by the ensuing claims. For instance, while the reduced end portions of the rectangular or square metal tubes included in the various embodiments of the present invention are preferably formed by the roll reduction process disclosed in co-pending U.S. patent application Ser. No. 08/957,354, these reduced end portions may be achieved by other methods such as die forming. The invention is therefore not limited to specific preferred embodiments as described, but is only defined by the following claims.

What is claimed is:

1. A system for framing at least a portion of a structure having a foundation, said system comprising:

a base, said base being attachable to the foundation of the structure;

a plurality of lower connecting members extending upwardly from said base, each of said lower connecting members comprising a metal tube selected from the group consisting of rectangular metal tubes and square metal tubes;

a plurality of upwardly extending support members, each of said support members comprising a metal tube selected from the group consisting of rectangular metal tubes and square metal tubes;

a plurality of lower joints interconnecting said upwardly extending support members and said lower connecting members, each of said lower joints interconnecting one of said support members and one of said lower connecting members, each of said support members having a cross-sectional shape which is substantially the same as a cross-sectional shape of said interconnected one of said lower connecting members;

wherein for each of said lower joints, one of said support member and said interconnected one of said lower connecting members has a reduced end portion which is inserted into the other of said support member and said interconnected one of said lower connecting members.

2. The system as recited in claim 1, wherein:

each of said support members includes an upper end portion, a lower end portion and an intermediate portion;

said reduced end portion of each one of at least a portion of said lower joints comprises said lower end portion of the corresponding one of said support members, said lower end portion of said corresponding one of said support members being inserted into said interconnected one of said lower connecting members.

3. The system as recited in claim 1, wherein:

each of said support members includes an upper end portion, a lower end portion and an intermediate portion;

each of said lower connecting members includes a lower portion attached to said base and an upper portion extending upwardly from said lower portion;

said reduced end portion of each one of at least a portion of said lower joints comprises said upper portion of the corresponding one of said lower connecting members, said upper portion of said corresponding one of said lower connecting members being inserted into said interconnected one of said support members.

4. The system as recited in claim 1, wherein:

said base comprises at least one metal tube selected from the group consisting of rectangular metal tubes and square metal tubes.

5. The system as recited in claim 1, wherein:

each of said lower connecting members and each of said upwardly extending support members comprises a rectangular metal tube.

6. The system as recited in claim 1, wherein:

each of said lower connecting members and each of said upwardly extending support members comprises a square metal tube.

7. The system as recited in claim 1, wherein:

said reduced end portion of each of said lower joints is formed by a roll reduction process.

8. The system as recited in claim 1, wherein:

each one of at least a portion of said support members is staked to the interconnected one of said lower connecting members.

9. The system as recited in claim 1, wherein:

each one of at least a portion of said support members is fastened to the interconnected one of said lower connecting members.

10. A system for framing at least a portion of a structure, said system comprising:

a base;

a plurality of lower connecting members attached to said base and extending upwardly therefrom, each of said lower connecting members comprising a metal tube selected from the group consisting of rectangular metal tubes and square metal tubes;

a plurality of upwardly extending support members, each of said support members comprising a metal tube selected from the group consisting of rectangular metal tubes and square metal tubes;

a plurality of lower joints interconnecting said upwardly extending support members and said lower connecting members, each of said lower joints interconnecting one of said support members and one of said lower connecting members each of said support members having a cross-sectional shape which is substantially the same as a cross-sectional shape of said interconnected one of said lower connecting members;

wherein for each of said lower joints, one of said support member and said interconnected one of said lower connecting members has a reduced end portion which is inserted into the other of said support member and said interconnected one of said lower connecting members; wherein each of said support members includes an upper end portion, a lower end portion and an intermediate portion;

said reduced end portion of each one of at least a portion of said lower joints comprises said lower end portion of the corresponding one of said support members, said lower end portion of said corresponding one of said support members being inserted into said interconnected one of said lower connecting members;

said system further comprising:

an upper member;

a plurality of upper connecting members attached to said upper member and extending downwardly therefrom, each of said upper connecting members comprising a metal tube selected from the group consisting of rectangular metal tubes and square metal tubes;

a plurality of upper joints interconnecting said upwardly extending support members and said upper connecting members, each of said upper joints interconnecting one of said support members and one of said upper connecting members, said cross-sectional shape of each of said support members being substantially the same as a cross-sectional shape of said interconnected one of said upper connecting members;

wherein for each of said upper joints, one of said support member and said interconnected one of said upper connecting members has a reduced end portion which is inserted into the other of said support member and said interconnected one of said upper connecting members.

11. The system as recited in claim 10, wherein:

said reduced end portion of each one of at least a portion of said upper joints comprises said upper end portion of the corresponding one of said support members, said upper end portion of said corresponding one of said support members being inserted into the interconnected one of said upper connecting members.

12. The system as recited in claim 10, wherein:

each of said upper connecting members includes an upper portion attached to said upper member and a lower portion extending downwardly from said upper portion;

said reduced end portion of each one of at least a portion of said upper joints comprises said lower portion of the corresponding one of said upper connecting members, said lower portion of said corresponding one of said upper connecting members being inserted into the interconnected one of said support members.

13. The system as recited in claim 10, wherein:

each of said lower connecting members, said upwardly extending support members and said upper connecting members comprises a rectangular metal tube.

14. The system as recited in claim 13, wherein:

said upper member comprises at least one rectangular metal tube.

15. The system as recited in claim 10, wherein:

each of said lower connecting members, said upwardly extending support members and said upper connecting members comprises a square metal tube.

16. The system as recited in claim 15, wherein:

said upper member comprises at least one rectangular metal tube.

17. The system as recited in claim 10, wherein:

said reduced end portion of each of said lower joints is formed by a roll reduction process;

said reduced end portion of each of said upper joints is formed by a roll reduction process.

18. A system for framing at least a portion of a structure, said system comprising:

a base;

a plurality of lower connecting members attached to said base and extending upwardly therefrom, each of said lower connecting members comprising a metal tube selected from the group consisting of rectangular metal tubes and square metal tubes;

a plurality of upwardly extending support members, each of said support members comprising a metal tube selected from the group consisting of rectangular metal tubes and square metal tubes;

a plurality of lower joints interconnecting said upwardly extending support members and said lower connecting members, each of said lower joints interconnecting one of said support members and one of said lower connecting members, each of said support members having a cross-sectional shape which is substantially the same as a cross-sectional shape of said interconnected one of said lower connecting members;

wherein for each of said lower joints, one of said support member and said interconnected one of said lower connecting members has a reduced end portion which is inserted into the other of said support member and said interconnected one of said lower connecting members; wherein each of said support members includes an upper end portion, a lower end portion and an intermediate portion:

each of said lower connecting members includes a lower portion attached to said base and an upper portion extending upwardly from said lower portion;

said reduced end portion of each one of at least a portion of said lower joints comprises said upper portion of the corresponding one of said lower connecting members, said upper portion of said corresponding one of said lower connecting members being inserted into said interconnected one of said support members;

said system further comprising:

an upper member;

a plurality of upper connecting members attached to said upper member and extending downwardly therefrom, each of said upper connecting members comprising a metal tube selected from the group consisting of rectangular metal tubes and square metal tubes;

a plurality of upper joints interconnecting said upwardly extending support members and said upper connecting members, each of said upper joints interconnecting one of said support members and one of said upper connecting members, said cross-sectional shape of each of said support members being substantially the same as a cross-sectional shape of said interconnected one of said upper connecting members;

wherein for each of said upper joints, one of said support member and said interconnected one of said upper connecting members has a reduced end portion which is inserted into the other of said support member and said interconnected one of said upper connecting members.

19. The system as recited in claim 18, wherein:

each of said upper connecting members includes an upper portion attached to said upper member and a lower portion extending downwardly from said upper portion;

said reduced end portion of each one of at least a portion of said upper joints comprises said lower portion of the corresponding one of said upper connecting members, said lower portion of said corresponding one of said upper connecting members being inserted into the interconnected one of said support members.

20. The system as recited in claim 18, wherein:

said reduced end portion of each one of at least a portion of said upper joints comprises said upper end portion of the corresponding one of said support members, said upper end portion of said corresponding one of said support members being inserted into the interconnected one of said upper connecting members.

21. The system as recited in claim 18, wherein:

each of said lower connecting members, said upwardly extending support members and said upper connecting members comprises a rectangular metal tube.

22. The system as recited in claim 21, wherein:

said upper member comprises at least one square metal tube.

23. The system as recited in claim 18, wherein:

each of said lower connecting members, said upwardly extending support members and said upper connecting members comprises a square metal tube.

24. The system as recited in claim 23, wherein:

said upper member comprises at least one square metal tube.

25. The system as recited in claim 18, wherein:

said reduced end portion of each of said lower joints is formed by a roll reduction process;

said reduced end portion of each of said upper joints is formed by a roll reduction process.

26. The system as recited in claim 18, wherein:

said upper member is substantially horizontally extending.

27. The system as recited in claim 18, wherein:

said upper member is inclined relative to horizontal.

28. A system for framing at least a portion of a structure having a foundation, said system comprising:

a plurality of wall frames interconnected to one another and extendable upwardly from the foundation of the structure, wherein each of said wall frames includes:

a base attachable to the foundation of the structure;

a plurality of lower connecting members attached to said base and extending upwardly therefrom, each of said lower connecting members comprising a rectangular metal tube;

a plurality of upwardly extending support members, each of said support members comprising a rectangular metal tube;

a plurality of lower joints interconnecting said plurality of said support members and said plurality of said lower connecting members, each of said lower joints interconnecting one of said support members and one of said lower connecting members, wherein for each of said lower joints one of said support member and said interconnected one of said lower connecting members has a reduced end portion which is inserted into the other of said support member and said interconnected one of said lower connecting members;

an upper member made of metal;

a plurality of upper connecting members attached to said upper member and extending downwardly therefrom, each of said upper connecting members comprising a rectangular metal tube, each of said upper connecting members being aligned with one of said lower connecting members;

a plurality of upper joints interconnecting said support members and said upper connecting members, each of said upper joints interconnecting one of said support members and one of said upper connecting members, each of said support members extending between one of said lower connecting members and said aligned one of said upper connecting members;

wherein for each of said upper joints, one of said support member and said interconnected one of said upper connecting members has a reduced end portion which is inserted into the other of said support member and said interconnected one of said upper connecting members.

29. The system as recited in claim 28, wherein:

said reduced end portion of each of said lower joints is formed by a roll reduction process.

30. The system as recited in claim 29, wherein:

said reduced end portion of each of said upper joints is formed by a roll reduction process.

31. The system as recited in claim 28, wherein at least one of said exterior wall frames further includes:

a window frame disposed between and connected to said base and said upper member.

32. The system as recited in claim 31, wherein said at least one of said exterior wall frames further includes:

a second plurality of lower connecting members attached to said base and extending upwardly therefrom;

a plurality of lower window frame connecting members attached to and extending downwardly from said window frame, each of said lower window frame connecting members being aligned with one of said second plurality of said lower connecting members;

a second plurality of upwardly extending support members, each of said second plurality of support members extending between and connected to one of said second plurality of said lower connecting members and said aligned one of said lower window frame connecting members;

wherein each of said second plurality of said lower connecting members, said plurality of lower window frame connecting members and said second plurality of support members comprises a rectangular metal tube.

33. The system as recited in claim 32, wherein said at least one of said exterior wall frames further includes:

a second plurality of upper connecting members attached to said upper member and extending downwardly therefrom;

a plurality of upper window frame connecting members attached to and extending upwardly from said window frame, each of said upper window frame connecting members being aligned with one of said second plurality of upper connecting members;

a third plurality of upwardly extending support members, each of said third plurality of said support members extending between and connected to one of said second plurality of said upper connecting members and said aligned one of said upper window frame connecting members;

wherein each of said second plurality of upper connecting members, said plurality of upper window frame connecting members and said third plurality of said support members comprises a rectangular metal tube.

34. The system as recited in claim 28, wherein at least one of said exterior wall frames further includes:

a door header disposed below and supported by said upper member.

35. The system as recited in claim 34, wherein said door header comprises a garage door header.

36. The system as recited in claim 28, further comprising:

an interior wall frame attached to and extending inwardly from one of said exterior wall frames, said interior wall frame including:

a base attached to the foundation of the structure;

a plurality of lower connecting members attached to an extending upwardly from said base;

an upper member spaced apart from said base;

a plurality of upper connecting members attached to and extending downwardly from said upper member, each of said upper connecting members being aligned with one of said lower connecting members;

a plurality of upwardly extending support members, each of said support members of said interior wall frame extending between and connected to one of said lower connecting members and an aligned one of said upper connecting members.

37. A system for framing a structure comprising:

a first base;

a second base laterally spaced apart from said first base;

a first plurality of lower connecting members attached to said first base and extending upwardly therefrom, each of said first plurality of lower connecting members comprising a metal tube selected from the group consisting of rectangular metal tubes and square metal tubes;

a plurality of upwardly extending first side posts, each of said first side posts comprising a metal tube selected from the group consisting of rectangular metal tubes and square metal tubes;

a first plurality of lower joints, each of said lower joints interconnecting one of said first plurality of lower connecting members and one of said first side posts, wherein for each of said first plurality of lower joints, one of said first side posts and said interconnected one of said first plurality of lower connecting members has a reduced end portion which is inserted into the other of said first side post and said interconnected one of said first plurality of lower connecting members, each of said first side posts having a cross-sectional shape which is substantially the same as the cross-sectional shape of said interconnected one of said first plurality of lower connecting members;

a second plurality of lower connecting members attached to said second base and extending upwardly therefrom, each of said second plurality of lower connecting members comprising a metal tube selected from the group consisting of rectangular metal tubes and square metal tubes, each of said second plurality of lower connecting members having a cross-sectional shape which is substantially the same as said cross-sectional sectional shape of said first plurality of lower connecting members and said plurality of first side posts, each of said second plurality of lower connecting members being aligned with one of said first plurality of said lower connecting members;

a plurality of upwardly extending second side posts, each of said second side posts comprising a metal tube selected from the group consisting of rectangular metal tubes and square metal tubes;

a second plurality of lower joints, each of said lower joints interconnecting one of said second plurality of lower connecting members and one of said second side posts, wherein for each of said second plurality of lower joints, one of said second side post and said interconnected one of said second plurality of said lower connecting members has a reduced end portion which is inserted into the other of said second side post and said interconnected one of said second plurality of said lower connecting members, each of said second side posts having a cross-sectional shape which is substantially the same as a cross-sectional shape of said interconnected one of said second plurality of said lower connecting members;

a plurality of bridge members, each of said bridge members extending between and interconnecting one of said first side posts and one of said second side posts.

38. The system as recited in claim 37, wherein each of said bridge members includes:

a pair of rafters and a peak disposed between and connected to each one of said pair of rafters; and wherein for each said bridge member, a first one of said rafters is connected to one of said first side posts and the other one of said rafters is connected to one of said second side posts which is aligned with said one of said first side posts;

each of said rafters and said peaks comprising a metal tube selected from the group consisting of rectangular metal tubes and square metal tubes.

39. A method of constructing a framing system for use in framing at least a portion of a structure, said method comprising the steps of:

providing a base made of metal;

making each one of a plurality of lower connecting members from a four-sided metal tube;

attaching each one of the lower connecting members to the base;

making each one of a plurality of support members from a four-sided metal tube;

interconnecting each one of the support members to one of the lower connecting members so that each of the support members extends upwardly from the interconnected one of the lower connecting members, said step of interconnecting comprising the steps of:

forming a reduced end portion on one of the support member and the lower connecting member for each interconnected pair of the support members and the lower connecting members;

inserting the reduced end portion into the other of the support member and the lower connecting member for each interconnected pair of the support members and the lower connecting members.

40. The method as recited in claim 39, wherein said step of forming comprises the step of:

roll reducing one end of one of the support member and the lower connecting member for each interconnected pair of the support members and the lower connecting members.

41. The method as recited in claim 40, further comprising the steps of:

providing an upper member comprising at least one four-sided metal tube;

making each one of a plurality of upper connecting members from a four-sided metal tube;

attaching each one of the upper connecting members to the upper member;

interconnecting each one of the support members to one of the upper connecting members, said step of interconnecting each one of the support members to one of the upper connecting members comprising the steps of:

forming a reduced end portion on one of the support member and the upper connecting member for each interconnected pair of the support members and the lower connecting members;

inserting the reduced end portion into the other of the support member and the lower connecting member for each interconnected pair of the support members and the lower connecting member.

42. The method as recited in claim 41, wherein said step of forming the reduced end portion on one of the support member and the upper connecting member comprises the step of:

roll reducing one end of one of the support member and the upper connecting member for each interconnected pair of the support members and the upper connecting members.

43. A system for framing at least a portion of a structure, said system comprising:

a base and an upper member;

a plurality of lower connecting members extending from said base and a plurality of upper connecting members extending from said upper member, each of said upper and lower connecting members comprising a four-sided metal tube;

a plurality of support members, each of said support members comprising a four-sided metal tube, each of said support members being interconnectable at one end with one of said upper connecting members and at the other end with an aligned one of said lower connecting members, each of said support members having a cross-sectional shape which is substantially the same as a cross-sectional shape of said interconnectable ones of said upper and lower connecting members;

wherein for each of said support members and at least one of said interconnectable upper and lower connecting members, one of said support member and said at least one of said interconnectable upper and lower connecting members has a reduced end portion of complementary shape to said cross-sectional shape of said support member, said reduced end portion being insertable into the other of said support member and said at least one of said interconnectable upper and lower connecting members.

44. The system as recited in claim 43, wherein:

each of said connecting members and said upwardly extending support members comprises a rectangular metal tube.

45. The system as recited in claim 43, wherein:

each of said connecting members and said upwardly extending support members comprises a square metal tube.

46. The system as recited in claim 43, wherein:

said reduced end portion is sized to snugly fit within said other of said support member and said interconnected one of said connecting members.

47. A system for framing at least a portion of a structure, said system comprising:

an upper member;

a plurality of upper connecting members attached to and extending downwardly from said upper member;

a plurality of upwardly extending support members, each of said support members comprising a four-sided metal tube, each of said support members being interconnected with one of said upper connecting members, each of said support members having a cross-sectional shape which is substantially the same as a cross-sectional shape of said interconnected one of said upper connecting members;

wherein for each of said support members and said interconnected one of said upper connecting members, one of said support member and said interconnected one of said upper connecting members has a reduced end portion of complementary shape to said cross-sectional shape of said support member and said interconnected one of said upper connecting members, said reduced end portion being inserted into the other of said support member and said interconnected one of said upper connecting members.

48. A system for framing at least a portion of a structure, said system comprising at least one wall frame, said at least one wall frame including:

a base having an upper surface;

a plurality of lower connecting members extending upwardly from said base, each of said lower connecting members being substantially perpendicular to said upper surface of said base, each of said lower connecting members comprising a four-sided metal tube;

a plurality of upwardly extending support members, each of said support members comprising a four-sided metal tube, each of said support members being interconnected with one of said lower connecting members, each of said support members having a cross-sectional shape which is substantially the same as a cross-sectional shape of said interconnected one of said connecting members;

wherein for each of said support members and said interconnected one of said lower connecting members, one of said support member and said interconnected one of said lower connecting members has a reduced end portion of complementary shape to said cross-sectional shape of said support member and said interconnected one of said lower connecting members, said reduced end portion being inserted into the other of said support member and said interconnected one of said lower connecting members.

49. A system for framing at least a portion of a structure, said system comprising at least one wall frame, said at least one wall frame including:

at least one of a lower supporting structure and an upper member;

a plurality of connecting members extending from said at least one of a lower supporting structure and an upper member, each of said connecting members comprising a four-sided metal tube;

a plurality of upwardly extending support members, said support members being substantially parallel to one another, each of said support members comprising a four-sided metal tube, each of said support members being interconnected with one of said connecting members, each of said support members having a cross-sectional shape which is substantially the same as a cross-sectional shape of said interconnected one of said connecting members;

wherein for each of said support members and said interconnected one of said connecting members, one of said support member and said interconnected one of said connecting members has a reduced end portion of complementary shape to said cross-sectional shape of said support member and said interconnected one of said connecting members, said reduced end portion being inserted into the other of said support member and said interconnected one of said connecting members.

50. The system as recited in claim 49, wherein:

said at least one of a lower supporting structure and an upper member comprises a lower supporting structure;

said lower supporting structure comprises a base.

51. A system for framing at least a portion of a structure having a foundation, said system comprising:

a plurality of wall frames interconnected to one another and extendable upwardly from the foundation of the structure, wherein each of said wall frames includes:

a base attachable to the foundation of the structure;

a plurality of lower connecting members attached to said base and extending upwardly therefrom, each of said lower connecting members comprising a rectangular metal tube;

a plurality of upwardly extending support members, each of said support members comprising a rectangular metal tube, each of said support members being interconnected with one of said lower connecting members, each of said support members having a cross-sectional shape which is substantially the same as a cross-sectional shape of said interconnected one of said lower connecting members, wherein for each of said support members and said interconnected one of said lower connecting members, one of said support member and said interconnected one of said lower connecting members has a reduced end portion of complementary shape to said cross-sectional shape of said support member and said interconnected one of said lower connecting members, said reduced end portion being inserted into the other of said support member and said interconnected one of said lower connecting members;

an upper member;

a plurality of upper connecting members attached to said upper member and extending downwardly therefrom, each of said upper connecting members comprising a rectangular metal tube, each of said upper connecting members being aligned with one of said lower connecting members, each of said upwardly extending support members being interconnected with one of said upper connecting members, said cross-sectional shape of each of said support members being substantially the same as a cross-sectional shape of said interconnected one of said upper connecting members, wherein for each of said support members and said interconnected one of said upper connecting members, one of said support member and said interconnected one of said upper connecting members has a reduced end portion of complementary shape to sad cross-sectional shape of said support member and said interconnected one of said upper connecting members, said reduced end portion being inserted into the other of said support member and said interconnected one of said upper connecting members.

52. A system for framing at least a portion of a structure having a foundation, said system comprising:

a plurality of wall frames interconnected to one another and extendable upwardly from the foundation of the structure, wherein each of said wall frames includes:

a plurality of upwardly extending suppose members, each of said support members comprising a four-sided metal tube;

an upper member; and a plurality of upper connecting members attached to said upper member and extending downwardly from said upper member, each of said upper connecting members comprising a four-sided metal tube, each of said upwardly extending support members being interconnected with one of said upper connecting members, wherein for each of said support members and said interconnected one of said upper connecting members, one of said support member and said interconnected one of said upper connecting members has a reduced end portion of complementary shape to a cross-sectional shape of said support member and which is inserted into the other of said support member and said interconnected one of said upper connecting members to snugly fit within.

53. The system as recited in claim 52 wherein:

each of said upwardly extending support members comprises a four-sided orthogonal metal tube;

each of said upper connecting members comprises a four-sided orthogonl metal tube.

54. The system as recited in claim 52, wherein:

each of said upwardly extending support members comprises a rectangular metal tube;

each of said upper connecting members comprises a rectangular metal tube.

55. A system for framing at least a portion of a structure having a foundation, said system comprising:

a plurality of wall frames interconnected to one another and extendable upwardly from the foundation of the structure, wherein each of said wall frames includes:

a base attachable to the foundation of the structure;

a plurality of lower connecting members attached to said base and extending upwardly therefrom, each of said lower connecting members comprising a four-sided metal tube;

a plurality of upwardly extending support members, each of said support members comprising a four-sided metal tube, each of said support members being interconnected with one of said lower connecting members, wherein for each of said support members and said interconnected one of said lower connecting members, one of said support member and said interconnected one of said lower connecting members has a reduced end portion of complementary shape to a cross-sectional shape of said support member which is inserted into the other of said support member and said interconnected one of said lower connecting members to snugly fit within.

56. The system as recited in claim 55, wherein:

each of said upwardly extending support members comprises a four-sided orthogonl metal tube;

each of said lower connecting members comprises a four-sided orthogonal metal tube.

57. The system as recited in claim 55, wherein:

each of said upwardly extending support members comprises a rectangular metal tube;

each of said lower connecting members comprises a rectangular metal tube.

58. A system for forming at least one wall frame for framing at least a portion of a building structure, said system formed from a plurality of interconnectable four-sided orthogonal metal tubes having substantially identical cross-sectional dimensions that interconnect with each other at their free ends with a free end of one metal tube having a reduced portion along each of its four orthogonal sides relative to a free end portion of a tube to which it connects, said reduced portion snugly and securely fitting within the end portion of the tube to which it connects, wherein said orthogonal metal tubes include vertically extending support members which are substantially parallel to one another and vertically extending connecting members, wherein one of said support members and connecting members include a reduced end portion relative to the other of said supporting members and connecting members wherein the support members are supported vertically by the connecting members.

59. The system as recited in claim 58, wherein:

said connecting members extend vertically from at least one of a base and an upper member.

60. The system as recited in claim 59, wherein said base is supported in a substantially horizontal direction.

61. A system for framing at least a portion of a structure having a foundation, said system comprising:

a plurality of wall frames interconnected to one another and extendable upwardly from the foundation of the structure, wherein each of said wall frames includes:

a plurality of interconnectable four-sided orthogonal metal tubes having substantially identical cross-sectional dimensions that interconnect with each other at their free ends with a free end of one metal tube having a reduced end portion along each of its four orthogonal sides relative to the free end portion of a tube to which it connects, said reduced end portion snugly and securely fitting within the end portion of the tube to which it connects.

62. A system for framing a structure comprising:

a first base having an upper surface;

a first plurality of lower connecting members extending upwardly from said base, each of said lower connecting members being substantially perpendicular to said upper surface of said first base, each of said first plurality of lower connecting members comprising a four-sided metal tube;

a plurality of upwardly extending first side posts, each of said first side posts comprising a four-sided metal tube, each of said first side posts being interconnected with one of said first plurality of lower connecting members;

wherein for each of said first side posts and said interconnected one of said first plurality of lower connecting members, one of said first side post and said interconnected one of said first plurality of lower connecting members has a reduced end portion of complementary shape to a cross-sectional shape of said first side post, said reduced end portion being inserted into the other of said first side post and said interconnected one of said first plurality of lower connecting members.

63. A system for framing a structure comprising:

a first base;

a first plurality of lower connecting members attached to said first base and extending upwardly therefrom, each of said first plurality of lower connecting members comprising a four-sided metal tube;

a plurality of upwardly extending first side posts, each of said first side posts comprising a four-sided metal tube, each of said first side posts being interconnected with one of said first plurality of lower connecting members;

wherein for each of said first side posts and said interconnected one of said first plurality of lower connecting members, one of said first side post and said interconnected one of said first plurality of lower connecting members has a reduced end portion of complementary shape to a cross-sectional shape of said first side post, said reduced end portion being inserted into the other of said first side post and said interconnected one of said first plurality of lower connecting members; said system further comprising:

a second base laterally spaced apart from said first base;

a second plurality of lower connecting members attached to said second base and extending upwardly therefrom, each of said second plurality of lower connecting members comprising a four-sided metal tube, each of said second plurality of lower connecting members being aligned with one of said first plurality of said lower connecting members;

a plurality of upwardly extending second side posts, each of said second side post comprising a four-sided metal tube, each of said second side post being interconnected with one of said second plurality of lower connecting members;

wherein for each of said second side posts and said interconnected one of said second plurality of lower connecting members, one of said second side post and said interconnected one of said second plurality of lower connecting members has a reduced end portion of complementary shape to a cross-sectional shape of said second side post, said reduced end portion being inserted into the other of said second side post and said interconnected one of said second plurality of lower connecting members.

64. The system as recited in claim 63, further comprising:

a plurality of bridge members, each of said bridge members extending between and interconnecting one of said first side posts and an aligned one of said second side posts.

65. A system for framing a structure composing:

a plurality of first side posts, each of said first side posts comprising a four-sided metal tube;

a plurality of second side posts laterally spaced from said first side posts, each of said second side posts comprising a four-sided metal tube and being substantially aligned with one of said first side posts;

a plurality of bridge members, each of said bridge members being interconnected to one of said first side posts and interconnected to an aligned one of said second side posts;

wherein for each of said first side posts and said interconnected one of said bridge members, one of said first side post and said interconnected one of said bridge members has a reduced end portion of complementary shape to a cross-sectional shape of said first side post and a cross-sectional shape of said bridge member, said reduced end portion being inserted into the other of said first side post and said interconnected one of said bridge members;

wherein for each of said second side posts and said interconnected one of said bridge members, one of said second side post and said interconnected one of said bridge members has a reduced end portion of complementary shape to a cross-sectional shape of said second side post and said cross-sectional shape of said interconnected one of said bridge members, said reduced end portion being inserted into the other of said second side post and said interconnected one of said bridge members.

66. A system for framing a structure comprising:

a plurality of first side posts, each of said first side posts comprising a four-sided metal tube;

a plurality of second side posts laterally spaced from said first side posts, each of said second side posts comprising a four-sided metal tube and being substantially aligned with one of said first side posts;

a plurality of laterally extending members, each of said laterally extending members being formed from at least one four-sided metal tube and interconnected to one of said first side posts and interconnected to an aligned one of said second side posts;

wherein for each of said first side posts and said interconnected one of said laterally extending members, one of said first side post and said interconnected one of said laterally extending members has a reduced end portion of complementary shape to a cross-sectional shape of said first side post and a cross-sectional shape of said laterally extending member, said reduced end portion being inserted into the offer of said first side post and said interconnected one of said laterally extending members;

wherein for each of said second side posts and said interconnected one of said laterally extending members, one of said second side post and said interconnected one of said laterally extending members has a reduced end portion of complementary shape to a cross-sectional shape of said second side post and said cross-sectional shape of said interconnected one of said laterally extending members, said reduced end portion being inserted into the other of said second side post and said interconnected one of said laterally extending members.

67. A system for framing a structure comprising:

a plurality of bridge members, each of said bridge members including a peak and first and second rafters, said peak being interconnected with said first and said second rafters, said peak and said first and second rafters each comprising a four-sided metal tube;

wherein for each of said peaks and said interconnected one of said first rafters, one of said peak and said interconnected one of said first rafters has a reduced end portion of complementary shape to a cross-sectional shape of said peak and a cross-sectional shape of said first rafter, said reduced end portion being inserted into the other of said peak and said interconnected one of said first rafters;

wherein for each of said peaks and said interconnected one of said second rafters, one of said peak and said interconnected one of said second rafters has a reduced end portion of complementary shape to said cross-sectional shape of said peak and a cross-sectional shape of said second rafter, said reduced end portion being inserted into the other of said peak and said interconnected one of said second rafters.

68. A system for constructing at least one wall frame for framing at least a portion of a structure having a foundation, said system comprising a plurality of interconnectable components to form the wall frame, said interconnectable components including:

at least one base, said at least one base being attachable to the foundation of the structure;

a plurality of lower connecting members extendable upwardly from said at least one base, each of said lower connecting members comprising a four-sided metal tube;

a plurality of support members, each of said support members comprising a four-sided metal tube, each of said support members being interconnectable with one of said lower connecting members and extendable upwardly therefrom, wherein for each of said support members and said interconnectable one of said lower connecting members, one of said support member and said interconnectable one of said lower connecting members has a reduced end portion of complementary shape to a cross-sectional shape of said support member and which is insertable into the other of said support member and said interconnectable one of said lower connecting members to snugly fit within.

69. The system as recited in claim 68, wherein:

said lower connecting members are attached to said at least one base;

said at least one base includes an upper surface and said lower connecting members are substantially perpendicular to said upper surface of said at least one base.

70. A system for framing a structure comprising:

a plurality of bridge members, each of said bridge members including a peak and first and second rafters, said peak being interconnectable with said first and second rafters, said peak and said first and second rafters each comprising a four-sided metal tube;

wherein for each of said peaks and said interconnectable one of said first rafters, one of said peak and said interconnectable one of said first rafters has a reduced end portion of complementary shape to a cross-sectional shape of said peak and a cross-sectional shape of said first rafter, said reduced end portion being insertable into the other of said peak and said interconnectable one of said first rafters;

wherein for each of said peaks and said interconnectable one of said second rafters, one of said peak and said interconnectable one of said second rafters has a reduced end portion of complementary shape to said cross-sectional shape of said peak and a cross-sectional shape of said second rafter, said reduced end portion being insertable into the other of said peak and said interconnectable one of said second rafters.

71. A system for constructing at least one wall frame for framing at least a portion of a structure having a foundation, said system comprising a plurality of interconnectable components to form the wall frame, said interconnectable components including:

at least one base, said at least one base being attachable to the foundation of the structure;

a plurality of lower connecting members extendable upwardly from said at least one base, each of said lower connecting members comprising a four-sided metal tube;

a plurality of support members, each of said support members comprising a four-sided metal tube, each of said support members being interconnectable with one of said lower connecting members and extendable upwardly therefrom, wherein for each of said support members and said interconnectable one of said lower connecting members, one of said support member and said interconnectable one of said lower connecting members has a reduced end portion which is insertable into the other of said support member and said interconnectable one of said lower connecting members to snugly fit within.

72. The system as recited in claim 71, wherein:

said lower connecting members are attached to said at least one base;

said at least one base includes an upper surface and said lower connecting members are substantially perpendicular to said upper surface of said at least one base.

73. A system for framing a structure comprising:

a plurality of bridge members, each of said bridge members including a peak and first and second rafters, said peak being interconnectable with said first and second rafters, said peak and said first and second rafters each comprising a four-sided metal tube;

wherein for each of said peaks and said interconnectable one of said first rafters, one of said peak and said interconnectable one of said first rafters has a reduced end portion which is insertable into the other of said peak and said interconnectable one of said first rafters;

wherein for each of said peaks and said interconnectable one of said second rafters, one of said peak and said interconnectable one of said second rafters has a reduced end portion which is insertable into the other of said peak and said interconnectable one of said second rafters.

74. A system for framing a structure comprising:

a plurality of first side posts, each of said first side posts comprising a four-sided metal tube;

a plurality of second side posts laterally spaced from said first side posts, each of said second side posts comprising a four-sided metal tube and being substantially aligned with one of said first side posts;

a plurality of bridge members, each of said bridge members being made of four-sided metal tubing, and each of said bridge members being interconnected to one of said first side posts and interconnected to an aligned one of said second side posts;

wherein for each of said first side posts and said interconnected one of said bridge members, one of said first side post and said interconnected one of said bridge members has a reduced end portion which is inserted into the other of said first side post and said interconnected one of said bridge members;

wherein for each of said second side posts and said interconnected one of said bridge members, one of said second side post and said interconnected one of said bridge members has a reduced end portion which is inserted into the other of said second side post and said interconnected one of said bridge members.

* * * * *

UNITED STATES PATENT AND TRADEMARK OFFICE

CERTIFICATE OF CORRECTION

PATENT NO. : 6,279,289 B1
DATED : August 28, 2001
INVENTOR(S) : James T. Soder and Bruce K. Ostrander It is certified that error appears in the above-identified patent and that said Letters Patent is hereby corrected as shown below:

Column 6,
Line 17, after "wall", "fires" is deleted and -- frames -- is inserted.

Column 14,
Line 59, after "by" "3 1/20" is deleted and -- 3 1/2 -- is inserted.

Column 18,
Line 5, before "includes", "farther" is deleted and -- further -- is inserted.

Column 19,
Line 2, after "the", "flaming" is deleted and -- framing -- is inserted.

Column 20,
Line 55, after "members", insert -- , --.

Column 29,
Line 54, after "to", "sad" is deleted and -- said -- is inserted.
Line 65, after "extending", "suppose" is deleted and -- support -- is inserted.

Column 30,
Line 21, after "four-sided", "orthogonl" is deleted and -- orthogonal -- is inserted.

Column 31,
Line 15, after "claim", "59" is deleted and -- 58 -- is inserted.

Signed and Sealed this

Eighth Day of October, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,279,289 B1
DATED : August 28, 2001
INVENTOR(S) : James T. Soder and Bruce K. Ostrander It is certified that error appears in the above-identified patent and that said Letters Patent is hereby corrected as shown below:

Column 6,
Line 17, after "wall", "fires" is deleted and -- frames -- is inserted.

Column 14,
Line 59, after "by" "3 1/20" is deleted and -- 3 1/2 -- is inserted.

Column 18,
Line 5, before "includes", "farther" is deleted and -- further -- is inserted.

Column 19,
Line 2, after "the", "flaming" is deleted and -- framing -- is inserted.

Column 20,
Line 55, after "members", insert -- , --.

Column 29,
Line 54, after "to", "sad" is deleted and -- said -- is inserted.
Line 65, after "extending", "suppose" is deleted and -- support -- is inserted.

Column 30,
Line 21, after "four-sided", "orthogonl" is deleted and -- orthogonal -- is inserted.

Column 31,
Line 15, after "claim", "59" is deleted and -- 58 -- is inserted.

UNITED STATES PATENT AND TRADEMARK OFFICE

CERTIFICATE OF CORRECTION

PATENT NO. : 6,279,289 B1
DATED : August 28, 2001
INVENTOR(S) : James T. Soder and Bruce K. Ostrander It is certified that error appears in the above-identified patent and that said Letters Patent is hereby corrected as shown below:

Column 32,
Lines 15 and 16, after "side", "post" is deleted and -- posts -- is inserted.
Line 34, after "structure", "composing" is deleted and -- comprising -- is inserted.

This certificate supersedes Certificate of Correction issued October 8, 2002.

Signed and Sealed this

Thirtieth Day of September, 2003

JAMES E. ROGAN
*Director of the United States Patent and Trademark Office*

US006279289C1

(12) EX PARTE REEXAMINATION CERTIFICATE (5754th)

United States Patent
Soder et al.

(10) Number: US 6,279,289 C1
(45) Certificate Issued: May 1, 2007

(54) METAL FRAMING SYSTEM

(75) Inventors: James T. Soder, Collierville, TN (US); Bruce K. Ostrander, Collierville, TN (US)

(73) Assignee: Mid-South Metal Products, Inc., Collierville, TN (US)

Reexamination Request:
No. 90/007,608, Jun. 29, 2005

Reexamination Certificate for:

| | |
|---|---|
| Patent No.: | **6,279,289** |
| Issued: | **Aug. 28, 2001** |
| Appl. No.: | **09/381,216** |
| Filed: | **Sep. 16, 1999** |

Certificate of Correction issued Oct. 8, 2002.

Certificate of Correction issued Sep. 30, 2003.

(22) PCT Filed: Mar. 19, 1998

(86) PCT No.: PCT/US98/05433

§ 371 (c)(1),
(2), (4) Date: Sep. 16, 1999

(87) PCT Pub. No.: WO98/41706

PCT Pub. Date: Sep. 24, 1998

Related U.S. Application Data

(60) Provisional application No. 60/040,835, filed on Mar. 19, 1997.

(51) Int. Cl.

| | |
|---|---|
| ***E04C 2/38*** | (2006.01) |
| ***E04C 2/34*** | (2006.01) |
| ***E04C 3/30*** | (2006.01) |
| ***E04B 9/00*** | (2006.01) |
| ***E06B 3/54*** | (2006.01) |
| ***E04H 12/00*** | (2006.01) |

(52) U.S. Cl. ..... 52/656.9; 52/479; 52/481.1; 52/726.1; 52/653.1

(58) Field of Classification Search ..... None
See application file for complete search history.

(56) References Cited

U.S. PATENT DOCUMENTS

| | | | |
|---|---|---|---|
| 672,548 | A | 4/1901 | Durall |
| 1,148,041 | A | 7/1915 | Minkler |
| 1,315,904 | A | 9/1919 | Bever |
| 1,500,841 | A | 7/1924 | Paske |
| 2,970,676 | A | 2/1961 | Maciunas |
| 3,200,554 | A | 8/1965 | Goodman et al. |

(Continued)

OTHER PUBLICATIONS

Boyce Industries, Boyce Trackburner Performance Products, 1994, p. 12, By. Boyce Industries, Melrose Park.

*Primary Examiner*—Beverly M. Flanagan

(57) ABSTRACT

A system and method are provided for framing at least a portion of a wide variety of structures. In each embodiment, the framing system includes a base, which may be attached to a foundation of the structure by conventional means, which preferably comprises at least one rectangular or square metal tube. Alternatively, the base may be made of other metal structures. The framing system further includes a plurality of lower connecting members attached to and extending upwardly from the base and a plurality of upwardly extending support members which are interconnected to the lower connecting members. The framing system may further include an upper member and a plurality of upper connecting members attached to and extending downwardly from the upper member. Each of the support members is also interconnected to one of the upper connecting members, which is aligned with one of the lower connecting members. The interconnections between the support members and the corresponding lower and upper connecting members may be achieved by various alternative configurations, but in each case one member has a reduced end portion which is inserted into a non-reduced end portion of the adjacent member. The reduced end portion is preferably achieved by a roll reduction process.

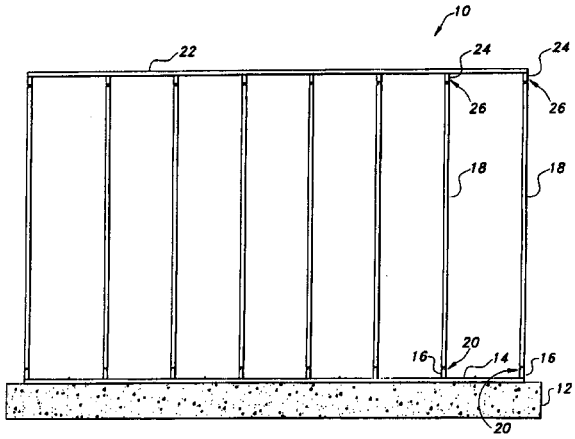

U.S. PATENT DOCUMENTS 3,255,768 A 6/1966 Lowe
3,480,313 A 11/1969 Halko
3,955,863 A 5/1976 Yellin
4,099,747 A 7/1978 Meserole
4,170,859 A 10/1979 Counihan ..... 52/763
4,179,858 A 12/1979 Graham et al. ..... 52/262
4,929,114 A 5/1990 Young
5,239,803 A 8/1993 Shannon ..... 52/653.1
5,285,606 A 2/1994 Hagemeyer ..... 52/204.68
5,287,666 A 2/1994 Frascaroli et al. ..... 52/239
5,319,906 A 6/1994 Hayden ..... 52/127.6
5,326,162 A 7/1994 Bovermann ..... 312/265.1
5,343,666 A 9/1994 Haddad et al. ..... 52/648.1
5,375,383 A 12/1994 Lin et al. ..... 52/217
5,394,665 A 3/1995 Johnson ..... 52/241
5,412,913 A 5/1995 Daniels et al. ..... 52/79.13
5,417,027 A 5/1995 Wagenet ..... 52/653.1
5,435,110 A 7/1995 Stol et al. ..... 52/655.1
5,471,805 A 12/1995 Becker ..... 52/241
5,479,733 A 1/1996 Kusina ..... 40/785
5,481,842 A 1/1996 Gautreau ..... 52/656.9
5,493,834 A 2/1996 Nelson ..... 52/349
5,501,547 A 3/1996 Mantelli ..... 405/121
5,526,614 A 6/1996 Huang et al. ..... 52/13
5,533,370 A 7/1996 Kuroda et al.
5,555,698 A 9/1996 Mandish ..... 52/745.17
5,560,174 A 10/1996 Goto ..... 52/655.1
5,575,129 A 11/1996 Goto ..... 52/655.1
5,579,622 A 12/1996 DeVon et al. ..... 52/653.1
5,590,505 A 1/1997 Bogle ..... 52/731.9
5,611,187 A 3/1997 Jones ..... 52/646

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 31–38, 63–67, 70, 73 and 74 is confirmed.

Claims 1–30, 39–62, 68, 69, 71 and 72 are cancelled.

* * * * *